US010928149B2

(12) United States Patent
Fridman et al.

(10) Patent No.: US 10,928,149 B2
(45) **Date of Patent: *Feb. 23, 2021**

(54) CLAY-PIGEON-LIKE PROJECTILE FOR CROWD CONTROL

(71) Applicants: ISPRA by El Ltd., Zichron-Yaacov (IL); Yariv Ben-Yehuda, Caesarea (IL)

(72) Inventors: Ofer Fridman, Haifa (IL); Yariv Ben-Yehuda, Caesarea (IL)

(73) Assignees: Yariv Ben-Yehuda, Caesarea (IL); ISPRA by El Ltd., Zichron-Yaacov (IL)

( * ) Notice: Subject to any disclaimer, the term of this patent is extended or adjusted under 35 U.S.C. 154(b) by 0 days.

This patent is subject to a terminal disclaimer.

(21) Appl. No.: 15/667,643

(22) Filed: Aug. 3, 2017

(65) Prior Publication Data

US 2017/0356707 A1 Dec. 14, 2017

Related U.S. Application Data

(63) Continuation of application No. 13/624,936, filed on Sep. 23, 2012, now Pat. No. 9,726,447.

(51) Int. Cl.
*F41A 9/61* (2006.01)
*F42B 12/46* (2006.01)
(Continued)

(52) U.S. Cl.
CPC . *F41A 9/61* (2013.01); *F41J 9/18* (2013.01); *F42B 10/26* (2013.01); *F42B 12/202* (2013.01);
(Continued)

(58) Field of Classification Search
CPC .. F41B 11/57; F41B 11/54; F41B 3/04; F42B 12/46
See application file for complete search history.

(56) References Cited

U.S. PATENT DOCUMENTS 3,380,383 A * 4/1968 Schnepfe, Jr. ..... F42B 12/50 102/368
3,646,888 A 3/1972 Posson et al.
(Continued)

FOREIGN PATENT DOCUMENTS

EP 0860683 8/1998
EP 0860683 A2 * 8/1998 ..... F41H 13/0006
(Continued)

OTHER PUBLICATIONS

Machine translation to EP 0860683A2.*
(Continued)

*Primary Examiner* — Melba Bumgarner
*Assistant Examiner* — Amir A Klayman

(57) ABSTRACT

A crowd control projectile includes a payload carrier, an incapacitating agent inside the payload carrier, and an activating mechanism for activating the incapacitating agent. The activating mechanism includes a sensor and a timer. The timer delays the activation until a predetermined delay after the sensor senses that the projectile has been launched. Alternatively, the activating mechanism includes a receiver for receiving an activation signal after the projectile has been launched. Preferably, the projectile has the shape of a clay pigeon. A launcher of such a projectile includes a communication mechanism for transmitting a timing signal or an activation signal to the projectile and an arm for launching the projectile by direct contact. To control a crowd, the projectile is launched over the crowd by direct contact with a solid arm and the activating mechanism is used to activate the incapacitating agent when the projectile is above the crowd.

18 Claims, 27 Drawing Sheets

(51) Int. Cl.

| | |
|---|---|
| ***F41J 9/18*** | (2006.01) |
| ***F42B 12/42*** | (2006.01) |
| ***F42B 10/26*** | (2006.01) |
| ***F42B 12/20*** | (2006.01) |
| ***F42B 30/00*** | (2006.01) |
| ***F41J 9/16*** | (2006.01) |

(52) U.S. Cl.
CPC ..... *F42B 12/42* (2013.01); *F42B 12/46* (2013.01); *F42B 30/00* (2013.01); *F41J 9/16* (2013.01)

(56) References Cited

U.S. PATENT DOCUMENTS

| | | | | |
|---|---|---|---|---|
| 3,731,631 | A * | 5/1973 | Berlin | F42C 14/02 102/487 |
| 3,733,727 | A | 5/1973 | Jones et al. | |
| 3,736,874 | A * | 6/1973 | Gerber | F42B 12/50 102/382 |
| 3,818,833 | A | 6/1974 | Throner, Jr. | |
| 3,953,132 | A * | 4/1976 | Michelsen | F41G 3/26 356/141.1 |
| 4,160,415 | A * | 7/1979 | Cole | F42C 13/04 102/214 |
| 4,463,745 | A | 8/1984 | Acker | |
| 5,259,360 | A | 11/1993 | Panara et al. | |
| 5,695,152 | A * | 12/1997 | Levy | F41G 7/222 244/3.13 |
| 6,155,155 | A * | 12/2000 | Moshier | F41B 3/04 102/211 |
| 6,202,532 | B1 * | 3/2001 | Kadushin | F42C 17/04 102/265 |
| 6,374,741 | B1 | 4/2002 | Stanley et al. | |
| 6,418,919 | B1 * | 7/2002 | Perrone | F41B 11/57 124/49 |
| 7,143,699 | B2 | 12/2006 | Brock et al. | |
| 7,213,518 | B2 * | 5/2007 | Sutcliffe | F42C 11/065 102/215 |
| 7,263,986 | B2 | 11/2007 | Lovell | |
| 7,373,849 | B2 * | 5/2008 | Lloyd | F42B 12/365 73/865.8 |
| 8,387,601 | B1 * | 3/2013 | Christensen | F41J 9/18 124/5 |
| 9,019,375 | B1 * | 4/2015 | Whelan | G01C 23/00 348/117 |
| 9,174,738 | B1 * | 11/2015 | Roach | B64D 1/12 |
| 9,410,783 | B1 * | 8/2016 | Khuc | F42C 15/40 |
| 2006/0162941 | A1 * | 7/2006 | Sridharan | A62C 3/025 169/53 |
| 2006/0189386 | A1 * | 8/2006 | Rosenberg | A63F 13/12 463/37 |
| 2008/0216699 | A1 | 9/2008 | McAleer et al. | |
| 2008/0254705 | A1 * | 10/2008 | Mathis | A63B 65/10 446/46 |
| 2008/0271900 | A1 * | 11/2008 | Korenkov | A62C 3/025 169/46 |
| 2010/0282115 | A1 * | 11/2010 | Sheridan | F42B 12/207 102/491 |
| 2011/0005373 | A1 | 1/2011 | Martinez et al. | |
| 2011/0048218 | A1 | 3/2011 | Ang et al. | |
| 2011/0100345 | A1 | 5/2011 | Minneman | |
| 2012/0210900 | A1 | 8/2012 | Kramer et al. | |
| 2013/0092763 | A1 | 4/2013 | Spearman, Sr. | |
| 2014/0083402 | A1 | 3/2014 | Fridman et al. | |
| 2015/0159846 | A1 * | 6/2015 | Hollinger | H05B 33/0806 362/183 |
| 2016/0216075 | A1 * | 7/2016 | Trail | F41G 7/222 |

FOREIGN PATENT DOCUMENTS

| | | |
|---|---|---|
| EP | 1617166 | 1/2006 |
| EP | 1742010 | 1/2007 |
| WO | WO 2014/045157 | 3/2014 |

OTHER PUBLICATIONS

Advisory Action Before the Filing of An Appeal Brief Dated Feb. 16, 2016 From the US Patent and Trademark Office Re. U.S. Appl. No. 13/624,936.

Applicant-Initiated Interview Summary Dated Jun. 10, 2015 From the US Patent and Trademark Office Re. U.S. Appl. No. 13/624,936.

Communication Pursuant to Article 94(3) EPC Dated Jun. 19, 2017 From the European Patent Office Re. Application No. 13838814.5. (4 Pages).

International Preliminary Report on Patentability Dated Apr. 2, 2015 From the International Bureau of WIPO Re. Application No. PCT/IB2013/058379.

International Search Report and the Written Opinion Dated Feb. 2, 2014 From the International Searching Authority Re. Application No. PCT/IB2013/058379.

Office Action Dated Jun. 14, 2016 From the Israel Patent Office Re. Application No. 222138 and Its Translation Into English.

Official Action Dated May 14, 2015 From the US Patent and Trademark Office Re. U.S. Appl. No. 13/624,936.

Official Action Dated Oct. 22, 2015 From the US Patent and Trademark Office Re. U.S. Appl. No. 13/624,936.

Official Action Dated May 26, 2016 From the US Patent and Trademark Office Re. U.S. Appl. No. 13/624,936.

Restriction Official Action Dated Jan. 7, 2015 From the US Patent and Trademark Office Re. U.S. Appl. No. 13/624,936.

Supplementary European Search Report and the European Search Opinion Dated Mar. 31, 2016 From the European Patent Office Re. Application No. 13838814.5.

Communication Pursuant to Article 94(3) EPC Dated Feb. 22, 2018 From the European Patent Office Re. Application No. 13838814.5. (6 Pages).

* cited by examiner

CLAY-PIGEON-LIKE PROJECTILE FOR CROWD CONTROL

RELATED APPLICATIONS

This application is a continuation of U.S. patent application Ser. No. 13/624,936 filed on Sep. 23, 2012. The contents of the above applications are all incorporated by reference as if fully set forth herein in their entirety.

FIELD AND BACKGROUND OF THE INVENTION

The present invention relates to projectiles and launch-systems, more particularly, to non-lethal projectiles and launch-systems for riot control.

Control of crowds and of areas where demonstrators gather is often achieved by the use of non-lethal riot control agents such as tear gas, stun grenades, pepper spray, etc.

Most conventional means for delivering the non-lethal riot control agents to the controlled crowd or area is done by firing the riot control agents using concentrated gas, created from pyrotechnic explosion or compressed gas, through some type of tube, e.g. barrel or tube canister, which gives a direction to the flight of the riot control agents.

The non-lethal effects depend on the payload carried by non-lethal projectiles. The most common payloads cause the following effects: kinetic damage (caused by physical hitting of the projectile), irritation (caused by irritant agent, such as tear gas, pepper powder, irritant liquid, etc.), shock and distraction (caused by flash-bang charge), incapacitation (caused by discharging a high voltage electric charge), disorientation (caused by smoke), etc. Also, there are payloads that combine two or more effects.

The design of prior art non-lethal projectiles depends on the type of the launcher used for their launching. Various forms of non-lethal projectiles are known. For example, such projectiles are disclosed in U.S. Pat. No. 3,733,727, in U.S. Pat. No. 7,143,699, and in many others. However, due to launchers' main shared concept of shoving projectiles through a tube, the generic design of projectiles is similar: they are designed to be shoved off from the tube by the power of concentrated gas. Therefore, the generic size and shape of prior art non-lethal projectiles is a bullet-like or shell-like size and shape.

The main drawback of prior art non-lethal projectiles is the fact that the pyrotechnic or pneumatic mechanisms of the launchers of the non-lethal projectiles constitute limitations for the different characteristics of counter-personnel non-lethal kinetic systems. Two significant limitations are: (1) the possibility of permanent damage, caused by direct hitting; and (2) the limited range of distances of the launchers, from the crowds that need to be controlled, over which the projectiles are both effective and safe.

There is therefore a need for non-lethal projectiles, and for launch-systems thereof, that will significantly reduce the possibility of direct hitting and, simultaneously, will be equally effective and safe at different distances.

Skeet shooting is a sport in which a shooter shoots at flying clay targets (saucer-like clay objects) that are commonly called "clay pigeons" and that are swung into the air by a manual thrower or by a launcher.

Referring now to the drawings, FIG. 1 is a perspective view schematic illustration of a prior art manual thrower P1 and a clay target P2. The clay target P2 is inserted into the manual thrower P1 which is then swung in the required direction.

FIG. 2 is a side view schematic illustration of a prior art mechanical launcher P3. Mechanical launcher P3 includes a launching arm P4 on which clay target P2 is loaded prior to launching and a spring P5. When mechanical launcher P3 is operated to launch clay target P2, spring P5 releases the energy stored within it and causes launching arm P4 to sweep clay target P2 in the required direction.

FIG. 3*a* is a side view schematic illustration of a prior art automatic launcher P6 in its unloaded state. Automatic launcher P6 is equipped with a magazine P7 which holds a multitude of clay targets P2 and dispenses clay targets P2 individually onto a launching surface P8. Launcher body P9 includes electrical motors, springs and other mechanisms required for reloading and launching processes. When magazine P7 drops a clay target P2 onto launching surface P8, launching arm P4 is released by main body P9 to sweep clay target P2 in the required direction.

Exemplary patent documents that describe conventional clay target launchers include U.S. Pat. Nos. 5,259,360, 7,263,986 and US Patent Application Publication No. 2011/0100345. These three documents are incorporated by reference for all purposes as if fully set forth herein.

SUMMARY OF THE INVENTION

The background art does not teach or suggest non-lethal projectiles and launch-systems which do not use compressed gas as a means to propel non-lethal riot control agents into crowds or areas that need to be controlled.

The present invention overcomes these deficiencies of the background art by providing exemplary non-lethal projectiles and by providing launch-systems for the projectiles. However, it should be noted that despite the description of the payloads of the projectiles of the present invention as non-lethal, it also is possible to use lethal agents in conjunction with the described projectiles and launch-system.

According to the present invention there is provided a projectile including: (a) a payload carrier; (b) an incapacitating agent, enclosed within the payload carrier; and (c) an activating mechanism, for activating the incapacitating agent, that includes: (i) a sensor for sensing a launch of the projectile without changing a shape of the projectile, and (ii) a timer for delaying the activating until a predetermined delay after the sensor senses the launch.

According to the present invention there is provided a projectile including: (a) a payload carrier; (b) an incapacitating agent, enclosed within the payload carrier, and (c) an activating mechanism, for activating the incapacitating agent, that includes a receiver for receiving, subsequent to the projectile having been launched, an activation signal that instructs the activating mechanism to activate the incapacitating agent.

According to the present invention there is provided a device, for launching a projectile, including: (a) a communication mechanism for transmitting a signal to the projectile; and (b) an arm for directly contacting and moving the projectile to launch the projectile.

According to the present invention there is provided a method of crowd control comprising the steps of: (a) providing a projectile that includes: (i) a payload carrier, (ii) an incapacitating agent, enclosed within the payload carrier, and an activating mechanism, for activating the incapacitating agent, selected from the group consisting of: (A) a first activating mechanism that includes: (I) a sensor for sensing a launch of the projectile without changing a shape of the projectile, and (II) a timer for delaying the activation until a predetermined clearly after the sensor senses the launch, and (B) a second activating mechanism that includes a receiver for receiving, subsequent to the projectile having been launched, an activation signal that instructs the activating mechanism to activate the incapacitating agent; (b) launching the projectile, to travel over the crowd to be controlled, by directly contacting and moving the projectile with a solid arm, and (c) using the activating mechanism, activating the incapacitating agent when the projectile is above the crowd.

The two basic embodiments of a projectile of the present invention both include a payload carrier, an incapacitating agent enclosed within the payload carrier, and an activating mechanism for activating the incapacitating agent. An "incapacitating agent" is an agent that, when activated by the activating mechanism, renders people or animals, at whom the projectile is launched, temporarily or permanently incapable of performing whatever action the user of the projectile is trying to prevent or delay. In the discussion below of the preferred embodiments, the exemplary preferred activating mechanisms are called "ignition units".

Preferably, the projectile does not have its own propulsion mechanism for launching and/or propelling the projectile towards its intended target, but instead must be launched by a separate launching device.

Preferably, the projectile is disk-shaped. Most preferably, the shape of the projectile is the shape of a conventional "clay pigeon" such as commonly is used in sports such as skeet shooting and trap shooting.

Although, as noted above, the activated incapacitating agent could be an agent that permanently incapacitates or even kills its target, it is preferred that the incapacitating agent be a riot control agent that is intended to incapacitate its target only temporarily. Such a riot control agent could be either passive or active. A passive riot control agent is an agent, such as pepper powder, that is deployed as such by the activating mechanism. An active riot control agent is a riot control agent that participates as a reactant in a chemical reaction that is initiated by the activation mechanism. In some preferred embodiments, the incapacitation of the target of the projectile is caused by a chemical product of the reaction, for example an irritant such as is produced by a conventional tear gas grenade. In other preferred embodiments, the incapacitation of the target of the projectile is caused by a physical effect of the reaction, for example the flash and bang of a stun grenade.

In the first basic embodiment of a projectile of the present invention, the activating mechanism includes a sensor and a timer. The sensor senses the launching of the projectile without changing the shape of the projectile. The timer delays the activating of the incapacitating agent until a predetermined delay after the sensor senses that the projectile has been launched. That the sensor operates without changing the shape of the projectile distinguishes the projectile of the present invention from e.g. a stun grenade whose lever springs off the grenade when the grenade is thrown.

Preferably, the activating mechanism also includes a mechanism for setting the predetermined delay. Most preferably, the mechanism for setting the predetermined delay includes a mechanism, such as an electrical contact on a surface of the projectile, or an antenna, for receiving a signal in which the predetermined delay is encoded. Alternatively, the mechanism for setting the predetermined delay includes an interface for manually setting the predetermined delay.

Preferably, the sensor senses the launch of the projectile by sensing an acceleration of the projectile.

In the second basic embodiment of a projectile of the present invention, the activating mechanism includes a receiver for receiving, subsequent to the projectile having been launched, an activation signal that instructs the activating mechanism to activate the incapacitating agent.

A basic device of the present invention for launching a projectile includes a communication mechanism for transmitting a signal to the projectile and an arm for launching the projectile by directly contacting and moving the projectile.

In one class of preferred embodiments, the communication mechanism includes an antenna for transmitting the signal wirelessly. The signal could include an activation instruction. The signal could include timing information.

In another class of preferred embodiments, the signal includes timing information. More preferably, the communication mechanism then includes one or more electrical contacts for transmitting the timing information to the projectile when the electrical contact(s) is/are in electrical communication with (a) corresponding electrical contact(s) of the projectile. In a first most preferred embodiment, the arm includes a receptacle, into which the projectile is loaded for launch, that includes the electrical contact(s). In second and third most preferred embodiments, the device also includes a launching surface on which the projectile is placed for launching, and the electrical contact(s) is/are on the launching surface. The third most preferred embodiment also includes a magazine for holding a plurality of the projectiles and for dispensing each projectile individually onto the launching surface so that the electrical contact(s) of the communication mechanism is/are in electrical communication with the corresponding electrical contact(s) of the dispensed projectile.

According to the crowd control method of the present invention, a projectile of the present invention is launched, to travel over the crowd to be controlled, by directly contacting and moving the projectile with a solid arm, and using the activating mechanism to activate the incapacitating agent when the projectile is above the crowd. Usually the crowd to be controlled is a crowd of people but it also could be a crowd of animals. The requirement to launch the projectile via the direct contact of a solid arm is one of the features of the method that distinguishes the method from conventional methods that rely on pyrotechnic or pneumatic mechanisms for launching crowd control projectiles. Although in principle the "solid arm" used to launch the projectile could be the arm and hand of a guard or a policeman who flings the projectile over the crowd like a Frisbee, it is preferable to use one of the launchers of the present invention to launch the projectile.

Additional objects and advantages of the invention will be set forth in part in the description which follows and, in part, will be obvious from the description, or may be learned by practice of the invention.

BRIEF DESCRIPTION OF THE SEVERAL VIEWS OF THE DRAWINGS

Various embodiments are herein described, by way of example only, with reference to the accompanying drawings, wherein.

DESCRIPTION OF THE PREFERRED EMBODIMENTS

The principles and operation of a crowd control projectile and launcher according to the present invention may be better understood with reference to the drawings and the accompanying description.

Figure 3A:
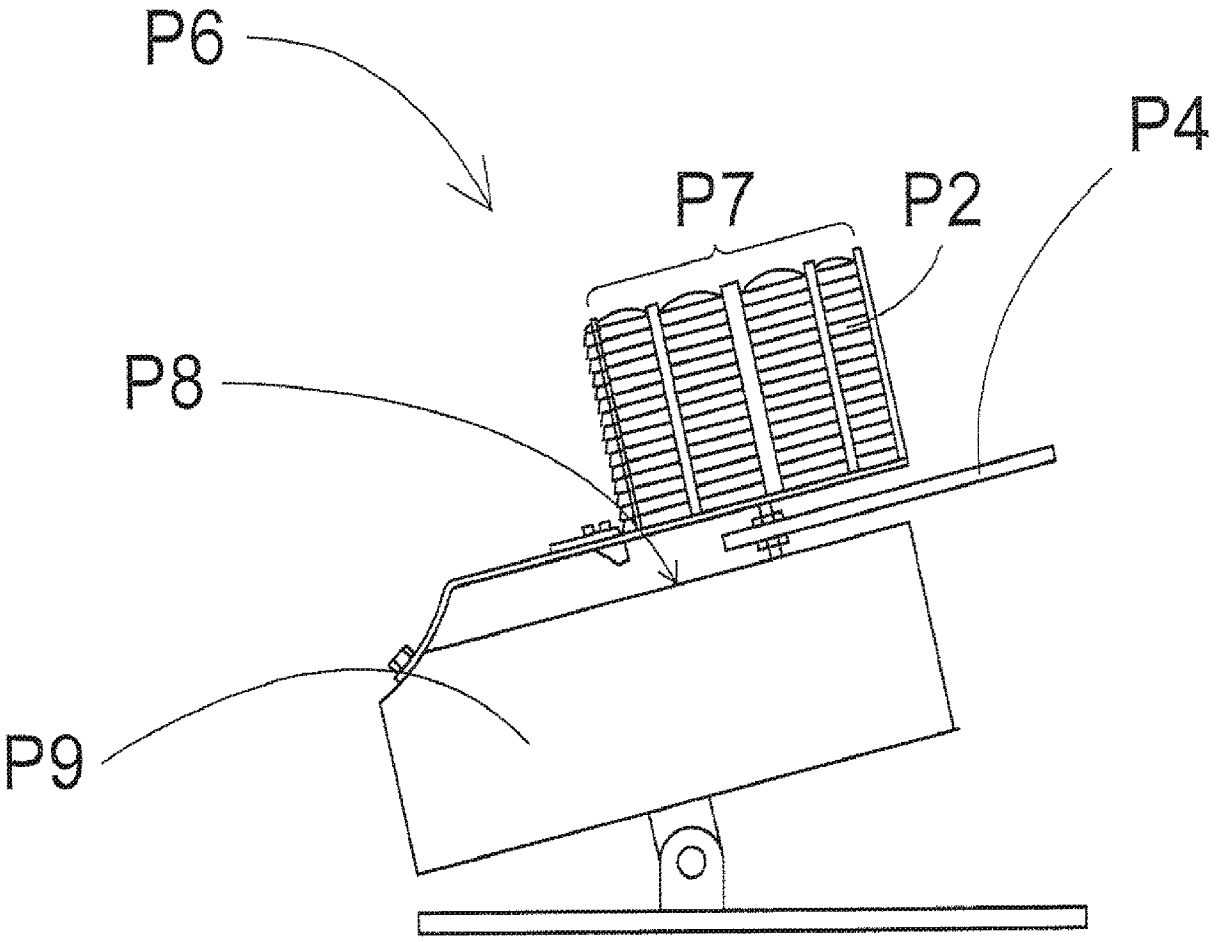
Fig. 3a PRIOR ART
FIG. 3*a* is a side view schematic illustration of a prior art automatic launcher in its unloaded state.
Figure 3B:
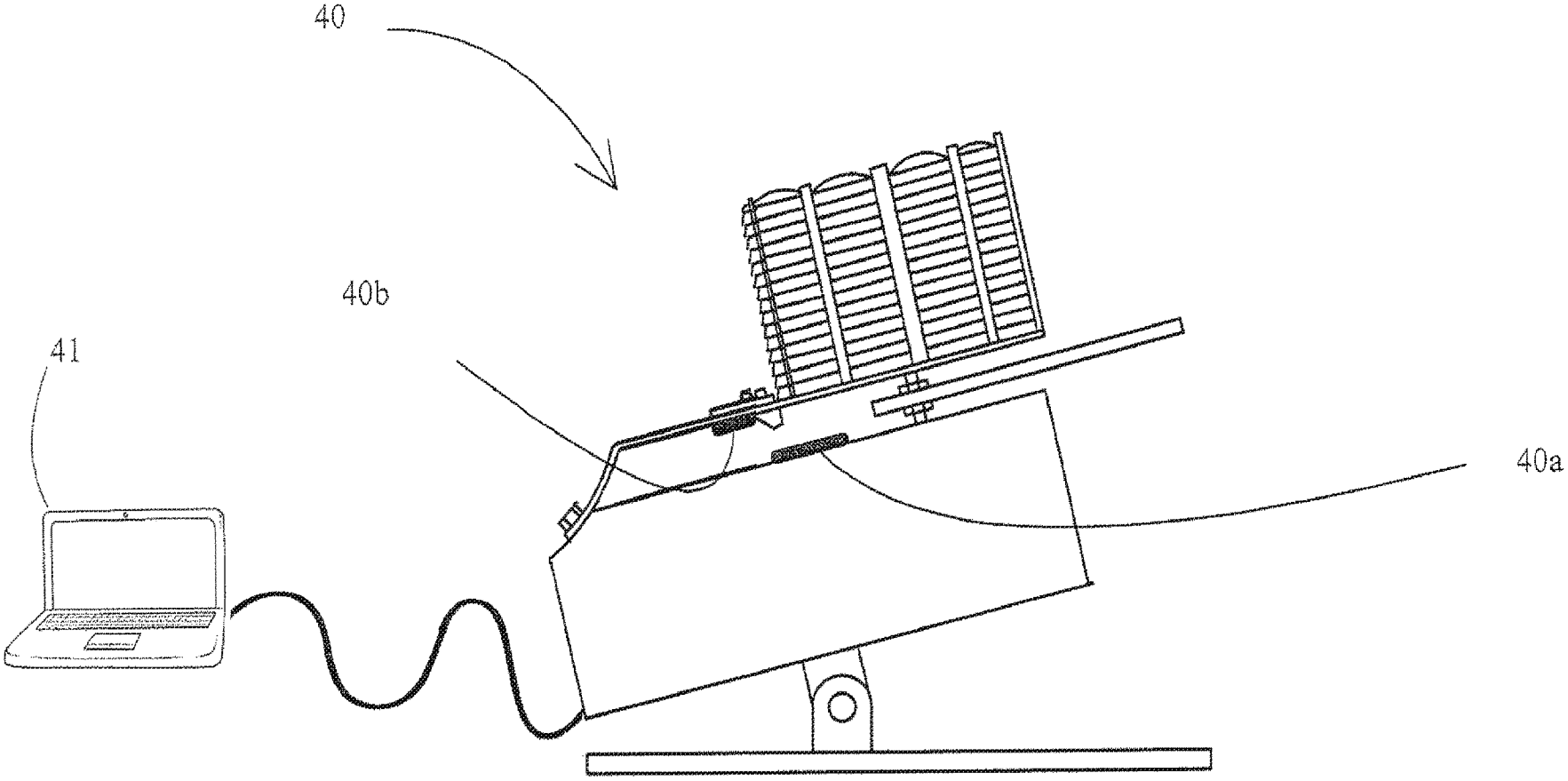
FIG. 3*b* is side view schematic illustration of exemplary modified automatic launcher (MAL) of the present invention in its unloaded state.

Referring again to the drawings, FIG. 3*b* is side-view schematic illustration of a modified automatic launcher (MAL) 40 in its unloaded state, according to the present invention. MAL 40 is automatic launcher P6 modified according to the principles of the present invention. MAL 40 includes a fire-control unit 41 and is equipped, on launching surface P5, with a contacting surface 40*a* used by fire-control unit 41 to communicate with the second embodiment of ignition unit 1*a* (not shown in the present illustration) that is described below, through contact strips 21*a* (shown in FIG. 9*c* below) and contacts 21 (shown in FIG. 9*b* below). Also, MAL 40 is equipped with an antenna 40*b* which is used by fire-control unit 41 to communicate with the first embodiment of ignition unit 1*a* (not shown in the present illustration) that is described below and that is equipped with an antenna 20*a* (shown in FIG. 8*a* below).

Figure 3C:
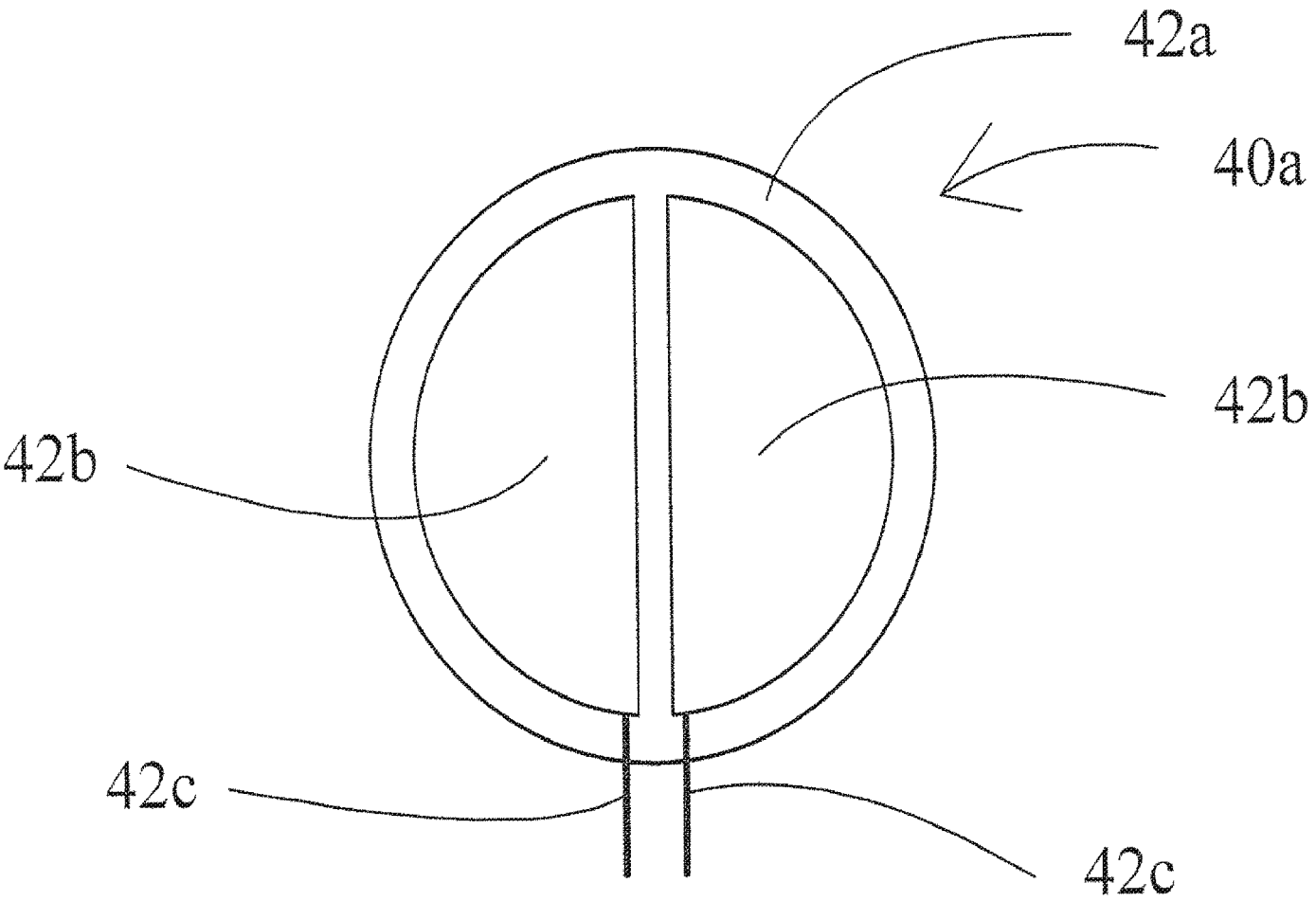
FIG. 3*c* is a top view schematic illustration of a contacting surface of an automatic launcher, according to the present invention.

FIG. 3*c* is a top-view schematic illustration of contacting surface 40*a* of MAL 40, according to the present invention. Contact surface 40*a* is equipped with several electrical contacts 42*b* (see FIG. 14 below) that are used to communicate data with the second embodiment of ignition unit 1*a* (not shown in the present illustration). Each electrical contact 42*b* is connected to fire-control unit 41 via a data contact wire 42*c*. All of the electrical contacts 42*b* are surrounded by an insulating surface 42*a* that electrically insulates electrical contacts 42*b* from each other and from launching surface P8.

Figure 4A:
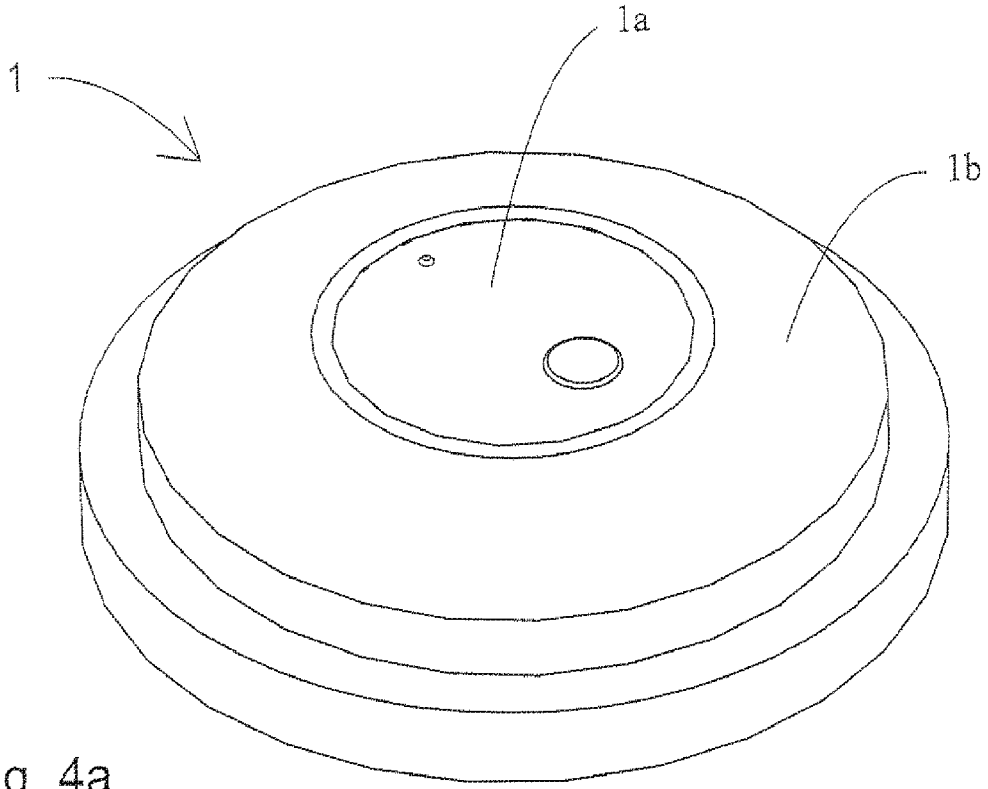
FIG. 4*a* is a perspective top-side view schematic illustration of a projectile of the present invention.

FIG. 4*a* is a perspective top-view schematic illustration of a projectile 1 of the present invention.

The overall shape and size of projectile 1 is that of the kind of generally disk-shaped or inverted-saucer-shaped clay target that is commonly used in sports such as skeet shooting and trap shooting and that commonly is referred to generically as a "clay pigeon". The standard size of such targets is 110 mm overall diameter and 25-26 mm thickness for international competition and 108 mm overall diameter and 28-29 mm thickness for American competition. There also are specialized targets such as "battue" targets that are thinner than the standard targets and "rabbit" targets that are thicker than the standard targets. So-called "midi" targets have a diameter of about 90 mm. So-called "mini" targets have a diameter of about 60 mm and a thickness of about 20 mm.

Figure 4B:
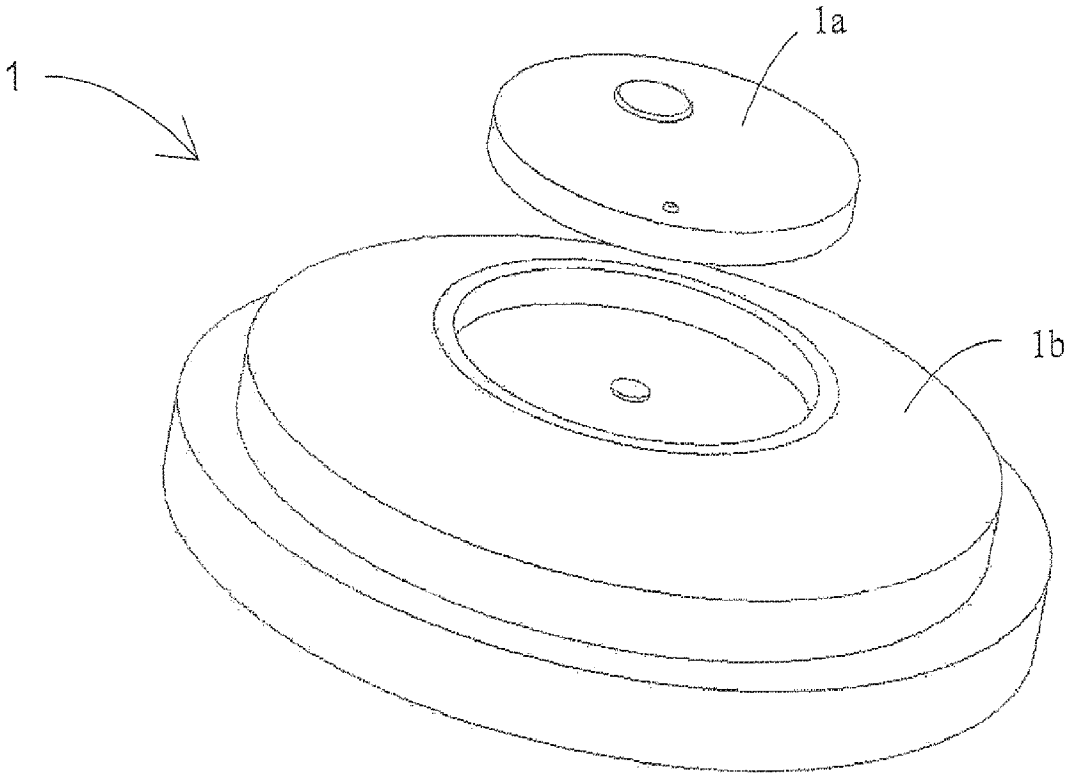
FIG. 4*b* is an exploded schematic illustration of a projectile of the present invention.

FIG. 4*b* is an exploded schematic illustration of projectile 1 showing that projectile 1 includes a payload carrier 1*b* and an ignition unit 1*a*. Four different preferred embodiments of ignition unit 1*a* are described below. Three different embodiments of payload carrier 1*b* are described below.

Figure 5A:
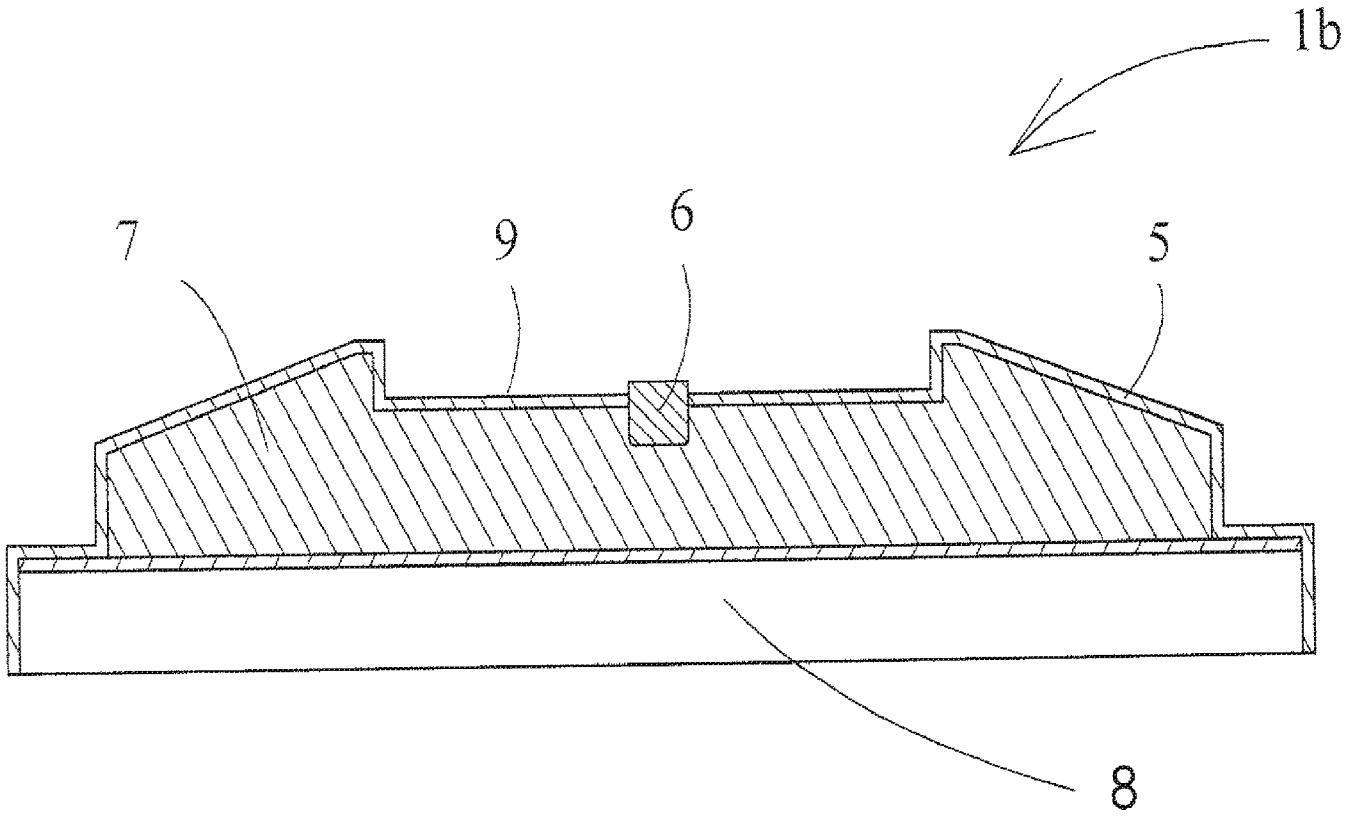
FIG. 5*a* is a cross sectional view of the first embodiment of a payload carrier.

FIG. 5*a* is cross sectional view of the first embodiment of payload carrier 1*b*. This embodiment of payload carrier 1*b* includes as its payload a passive payload such as powder or liquid.

Figure 5B:
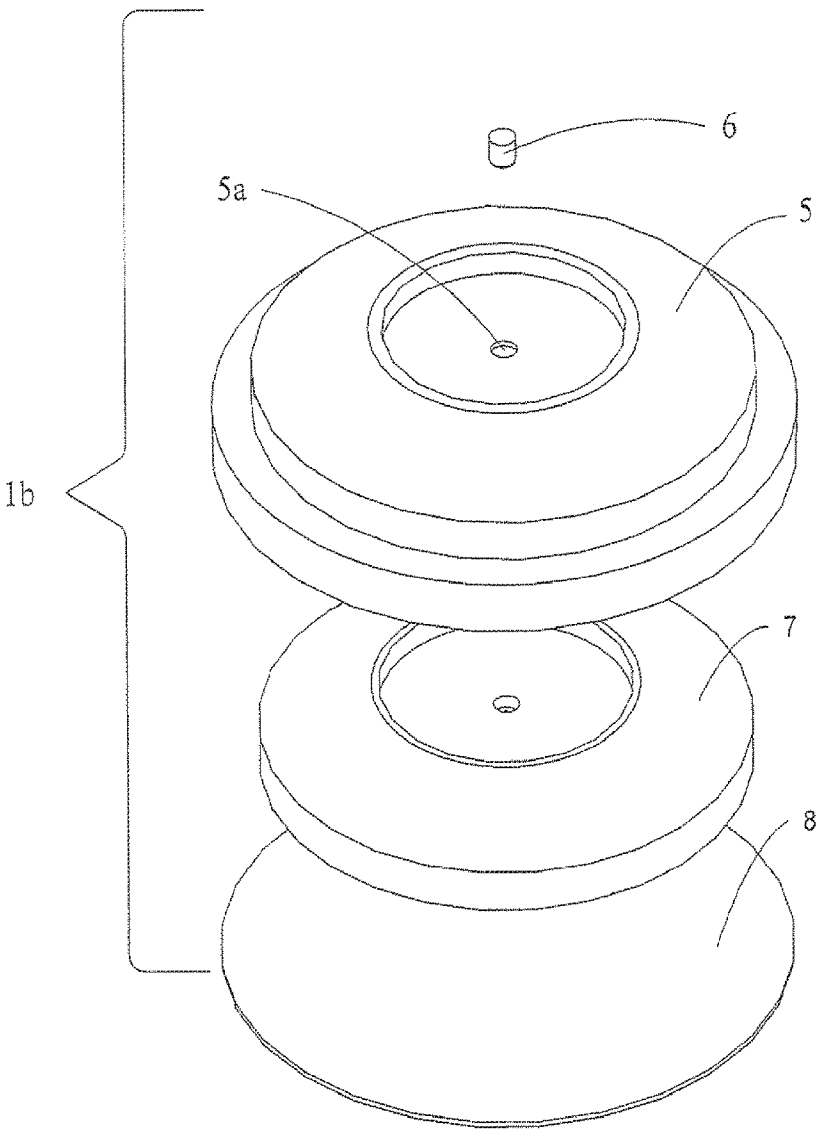
FIG. 5*b* is an exploded schematic illustration of the first embodiment of a payload carrier.

FIG. 5*b* is an exploded schematic illustration of the first embodiment of payload carrier 1*b*. This embodiment of payload carrier 1*b* includes a payload shell 5, a pyrotechnic fuse 6, a passive payload 7 and a passive payload bottom cover 8.

According to the present invention all types of ignition unit 1*a* described below can be installed in the recess 9 on the top surface of a first embodiment 1*b* of a payload carrier. Pyrotechnic fuse 6 is located between the pyrotechnic fuse nest 20*m* in the bottom of an ignition unit 1*a* (not shown in the present figure) and passive payload 7, through a hole 5*a* in shell 5. Pyrotechnic fuse 6 is ignited by the ignition unit 1*a*. After its ignition, pyrotechnic fuse 6 creates an explosion that tears through the bottom cover 8 and/or disconnects bottom cover 8 from shell 5. Then, passive payload 7 is dispersed in the air as passive payload 7 falls out of shell 5.

Figure 6A:
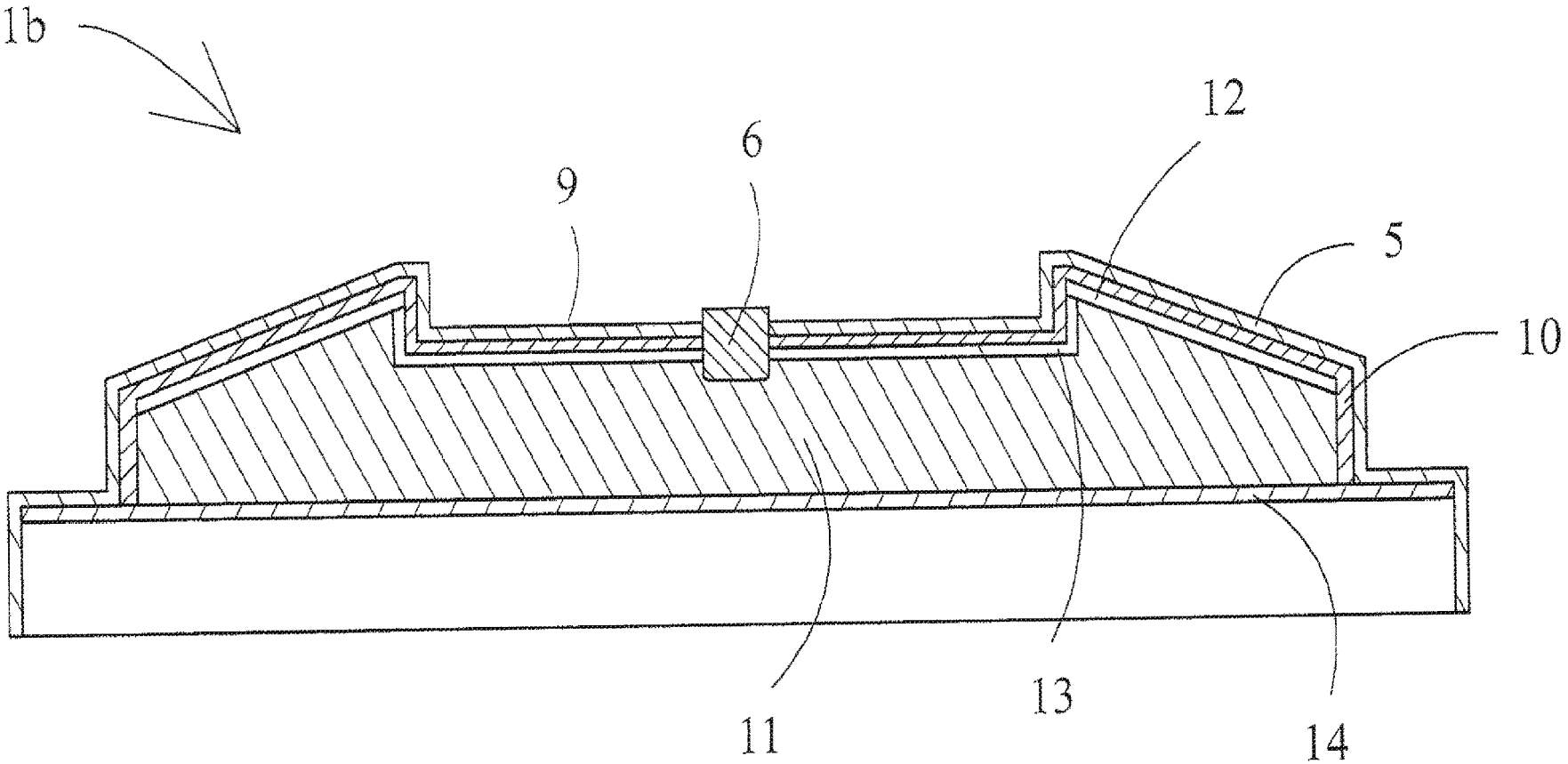
FIG. 6*a* is a cross sectional view of the second embodiment of a payload carrier.

FIG. 6*a* is cross sectional view of the second embodiment of a payload carrier 1*b*. This embodiment of the payload carrier 1*b* includes as its payload an active payload that produces an irritant material such as smoke or tear gas.

Figure 6B:
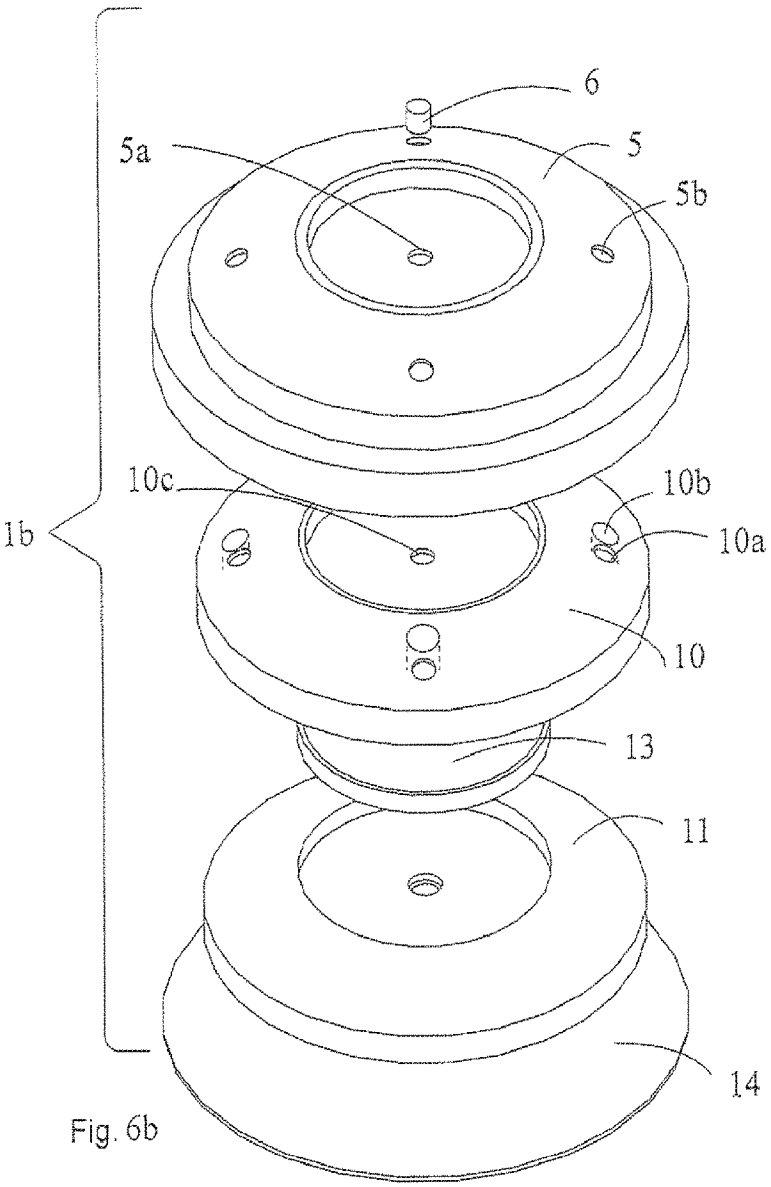
FIG. 6*b* is an exploded schematic illustration of the second embodiment of a payload carrier.

FIG. 6*b* is an exploded schematic illustration of the second embodiment of payload carrier 1*b*. This embodiment of payload carrier 1*b* includes a payload shell 5, a pyrotechnic fuse 6, a secondary payload canister 10, an igniter washer 13, an active payload 11 and an active payload bottom cover 14.

According to the present invention all types of ignition unit 1*a* described below can be installed in the recess 9 on the top surface of second embodiment 1*b* of a payload carrier. Pyrotechnic fuse 6 is located between the pyrotechnic fuse nest 20*m* in the bottom of an ignition unit 1*a* (not shown in the present figure) and igniter washer 13, through hole 5*a* in shell 5 and hole 10*c* in secondary payload canister 10. Ignition unit 1*a* ignites pyrotechnic fuse 6, which in turn ignites igniter washer 13. The burning of igniter washer 13 along the surface of active payload 11 produces an irritant agent. One example of active payload 11 is a mixture of a lachrymator such as CS or CN and a heat generating material such as smokeless powder. Combustion of the heat generating material vaporizes the lachrymator. The irritant agent thus produced is concentrated within an open space 12. The irritant agent, being hot and pressurized, tears membranes 10*b* and is dispersed in the air through holes 10*a* in secondary payload canister 10 and holes 5*b* in shell 5.

Figure 7A:
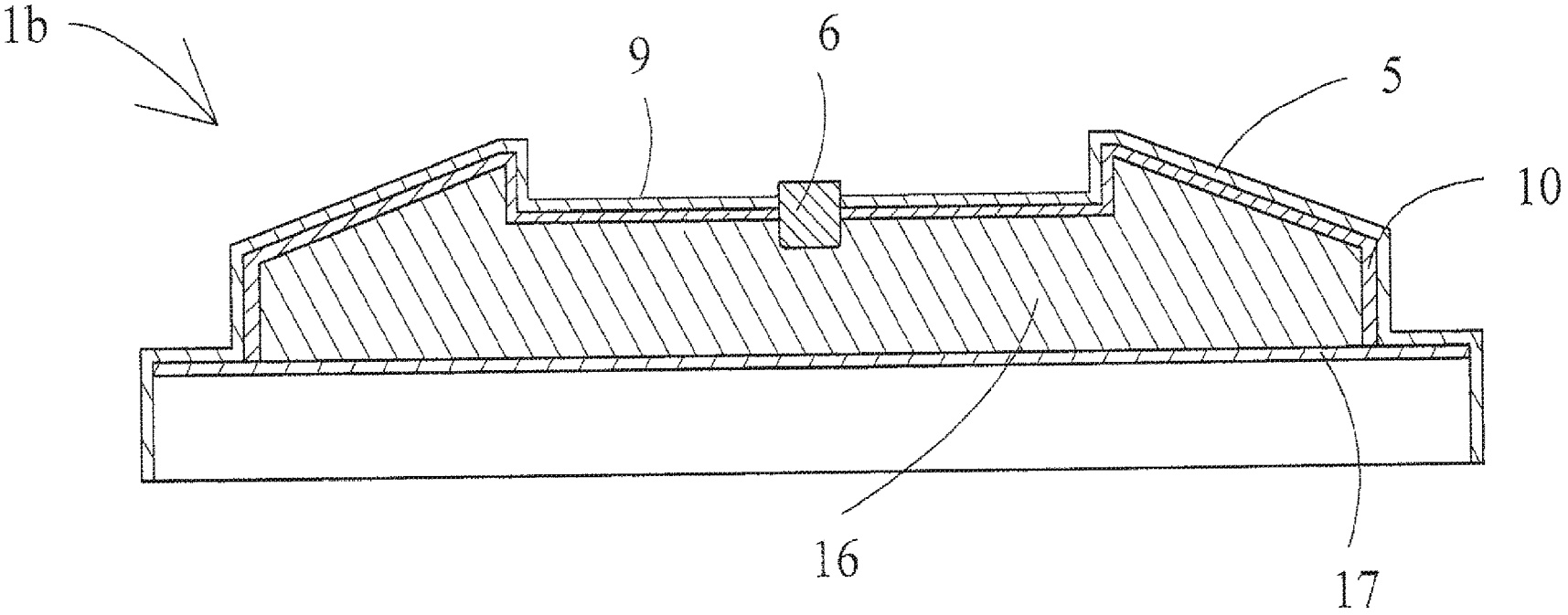
FIG. 7*a* is a cross sectional view of the third embodiment of a payload carrier.

FIG. 7*a* is cross sectional view of the third embodiment of payload carrier 1*b*. This embodiment of payload carrier 1*b* includes as its payload an explosive charge that creates a loud noise accompanied by a blinding flash of light, in the manner of a stun grenade.

Figure 7B:
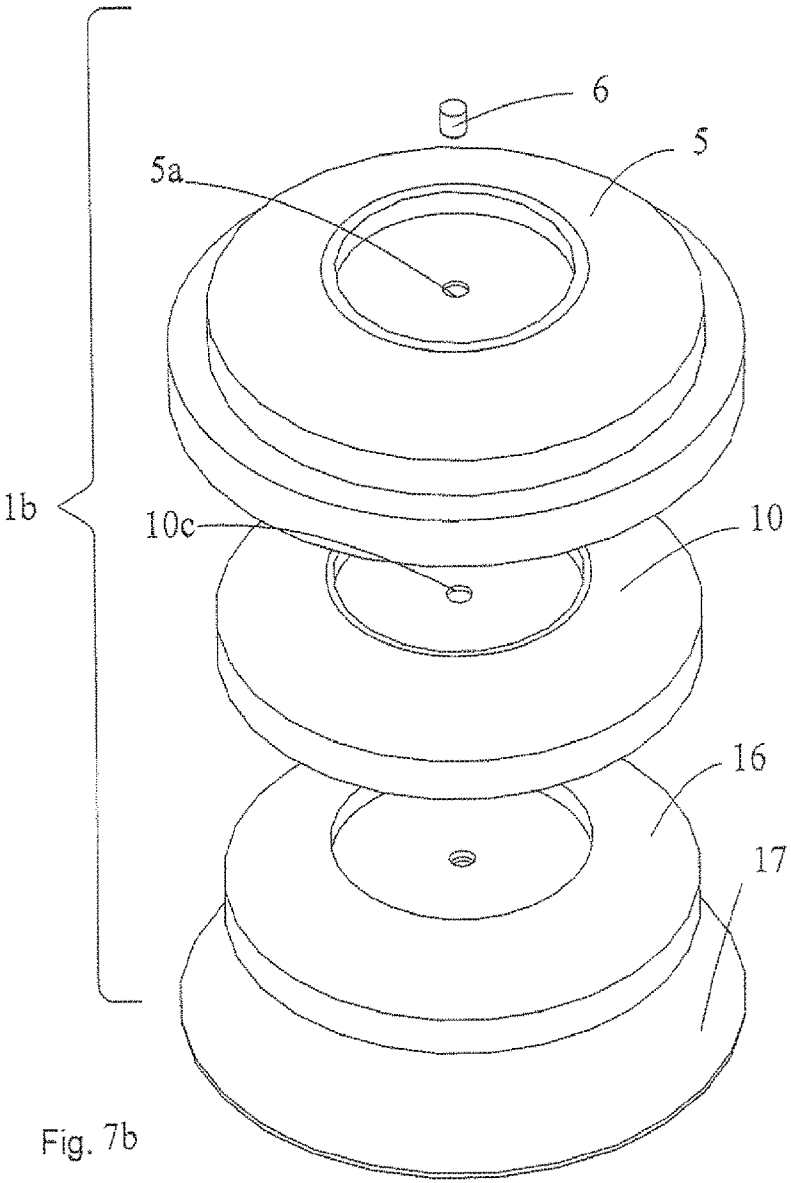
FIG. 7*b* is an exploded schematic illustration of the third embodiment of a payload carrier.

FIG. 7*b* is an exploded schematic illustration of the third embodiment of payload carrier 1*b*. This embodiment of payload carrier 1*b* includes a payload shell 5, a pyrotechnic fuse 6, a secondary payload canister 10, an explosive charge 16 and an explosive charge bottom cover 17.

According to the present invention all types of ignition unit 1*a* described below can be installed in the recess 9 on the top surface of the third embodiment of payload carrier 1*b*. Pyrotechnic fuse 6 is located between the pyrotechnic fuse nest 20*m* in the bottom of ignition unit 1*a* (not shown in the present figure) and explosive charge 16, through a hole 5*a* in shell 5 and hole 10*c* in secondary payload canister 10. Ignition unit 1*a* ignites pyrotechnic fuse 6, which in turn ignites explosive charge 16. The explosion of explosive charge 16 produces a loud noise accompanied by a temporarily blinding flash.

Figure 8B:
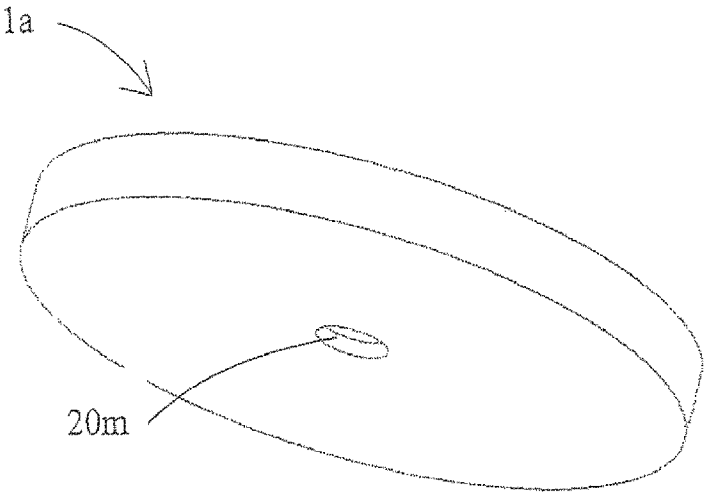
FIG. 8*b* is a perspective bottom-side view schematic illustration of the first embodiment of an ignition unit.
Figure 8A:
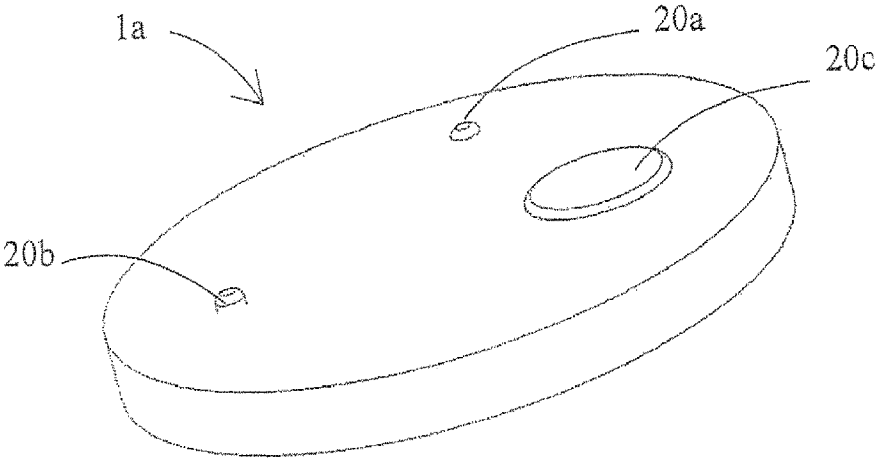
FIG. 8*a* is a perspective top-side view schematic illustration of the first embodiment of an ignition unit.

FIG. 8*a* is a perspective top-view schematic illustration of a first embodiment of ignition unit 1*a*.

FIG. 8*b* is a perspective bottom-view schematic illustration of the first embodiment of ignition unit 1*a*.

Figure 8C:
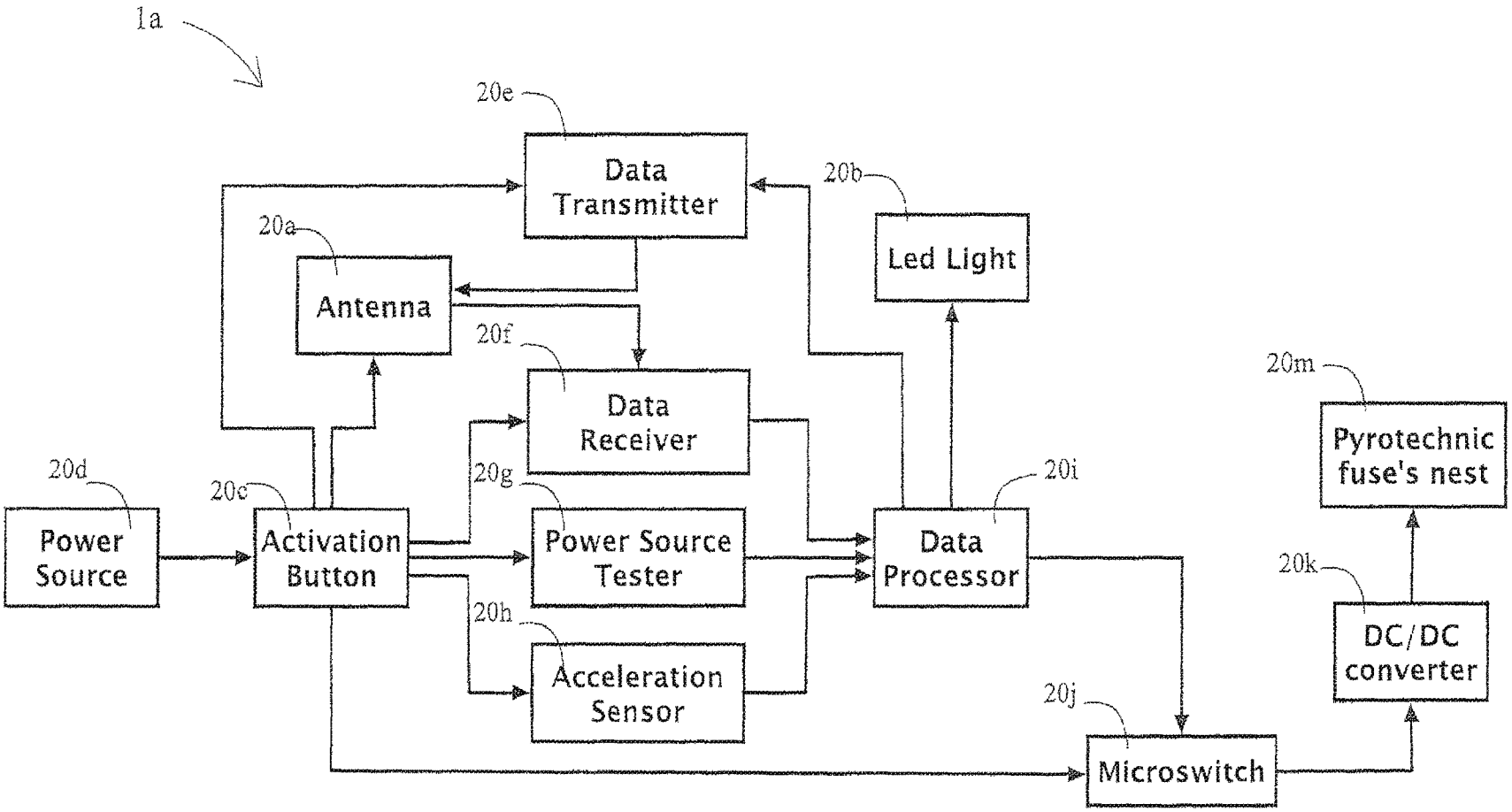
FIG. 8*c* is a block diagram of the electronic system of the first exemplary embodiment of an ignition unit.

FIG. 8*c* is a block diagram of the electronic system of the first exemplary embodiment of ignition unit 1*a*. The launching of a projectile 1 that includes this embodiment of ignition unit 1*a* preferably is done using a modified manual thrower (MMT) (described below with reference to FIGS. 12A and 12B), a modified mechanical launcher (MML) (described below with reference to FIG. 14) or a modified automatic launcher (MAL) (described above with reference to FIG. 3*b* and below with reference to FIG. 14). The electronic system of the first exemplary embodiment of ignition unit 1*a* includes a power source 20*d*, which supplies power through an activation button 20*c* that is operatively connected to an antenna 20*a*, a data transmitter 20*e*, a data receiver 20*f*, a power source tester 20*g*, an acceleration sensor 20*h* and a micro-switch 20*j*. A data processor 20*i* receives data from data receiver 20*f*, from the power source tester 20*g* and from the acceleration sensor 20*h*, and outputs data to a LED light 20*b*, to micro-switch 20*j* and to data transmitter 20*e*. Data transmitter 20*e* outputs data it gets from activation button 20*c* and from data processor 20*i* to antenna 20*a* for transmission to a fire control unit such as fire control unit 24*b* of FIG. 12*a* below or fire control unit 41 of FIG. 3*b* above and FIG. 14 below. Micro-switch 20*j* receives data from data processor 20*i* and from activation button 20*c* and outputs a direct current (DC) voltage to a DC/DC converter 20*k* which converts the received DC voltage to a level suitable for ignition of pyrotechnic fuse 6 of payload carrier 1*b* (not shown in this figure) in contact with a pyrotechnic fuse nest 20*m*.

Upon system startup using activation button 20*c*, power source tester 20*g* informs data processor 20*i* when the power source 20*d* voltage level is suitable for operation of ignition unit 1*a* and data processor 20*i* then lights up LED light 20*b*. Data processor 20*i* then receives required data (such as detonation command, delay time, identification number, etc.) via wireless transmission from fire-control unit 24*b* or 41 (not shown in the present figure) via antenna 20*a* and data receiver 20*f*, and then signals a "ready" signal back through data transmitter 20*e* and antenna 20*a*, or by signaling with LED light 20*b*. When projectile 1 is launched, acceleration sensor 20*h* senses the launch and signals to the data processor 20*i* that projectile 1 has been launched. Upon receiving the launch indication from acceleration sensor 20*h*, data processor 20*i* starts to count down the delay time received before launch or waits for a detonation command, after which, data processor 20*i* signals micro-switch 20*j* to pass the required DC voltage to pyrotechnic fuse nest 20*m* via DC/DC converter 20*k*, thereby detonating pyrotechnic fuse 6 (not shown in present figure).

Figure 9B:
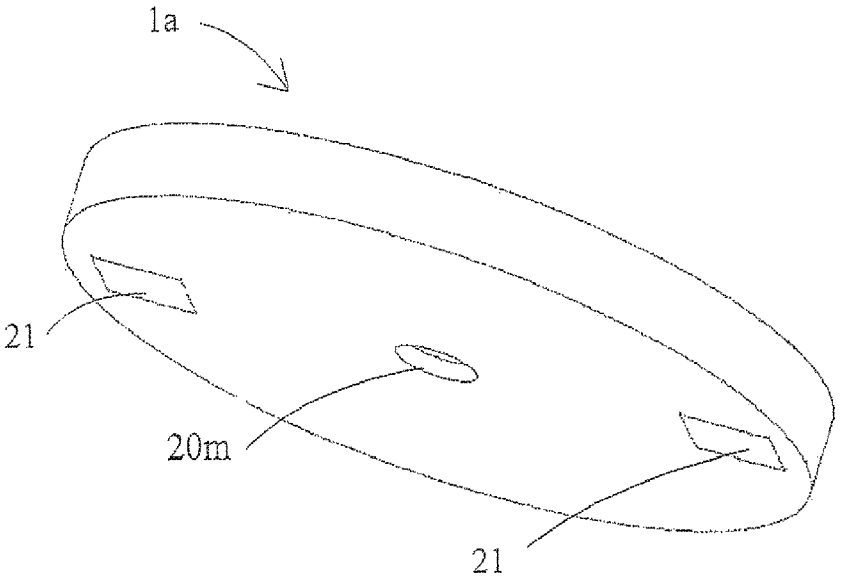
FIG. 9*b* is a perspective bottom-side view schematic illustration of the second embodiment of an ignition unit.
Figure 9A:
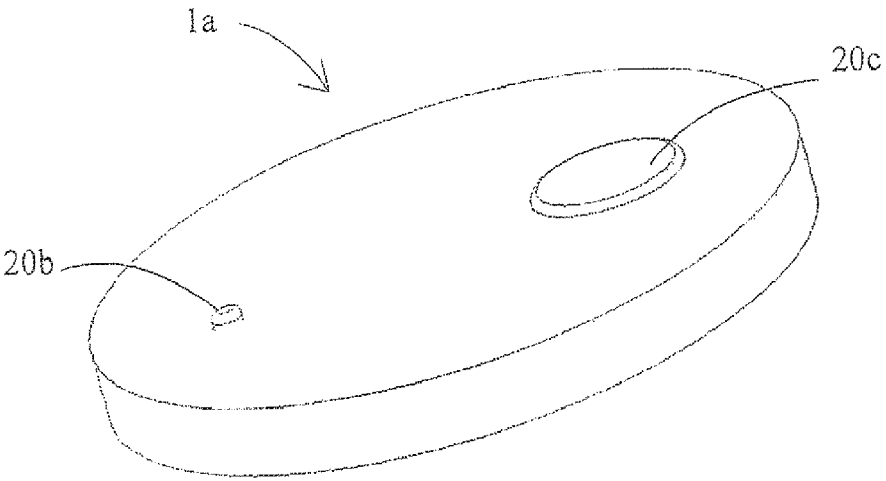
FIG. 9*a* is a perspective top-side view schematic illustration of the second embodiment of an ignition unit.

FIG. 9*a* is a perspective top view schematic illustration of a second embodiment of ignition unit 1*a*.

FIG. 9*b* is a perspective bottom view schematic illustration of the second embodiment of an ignition unit 1*a*.

Figure 9C:
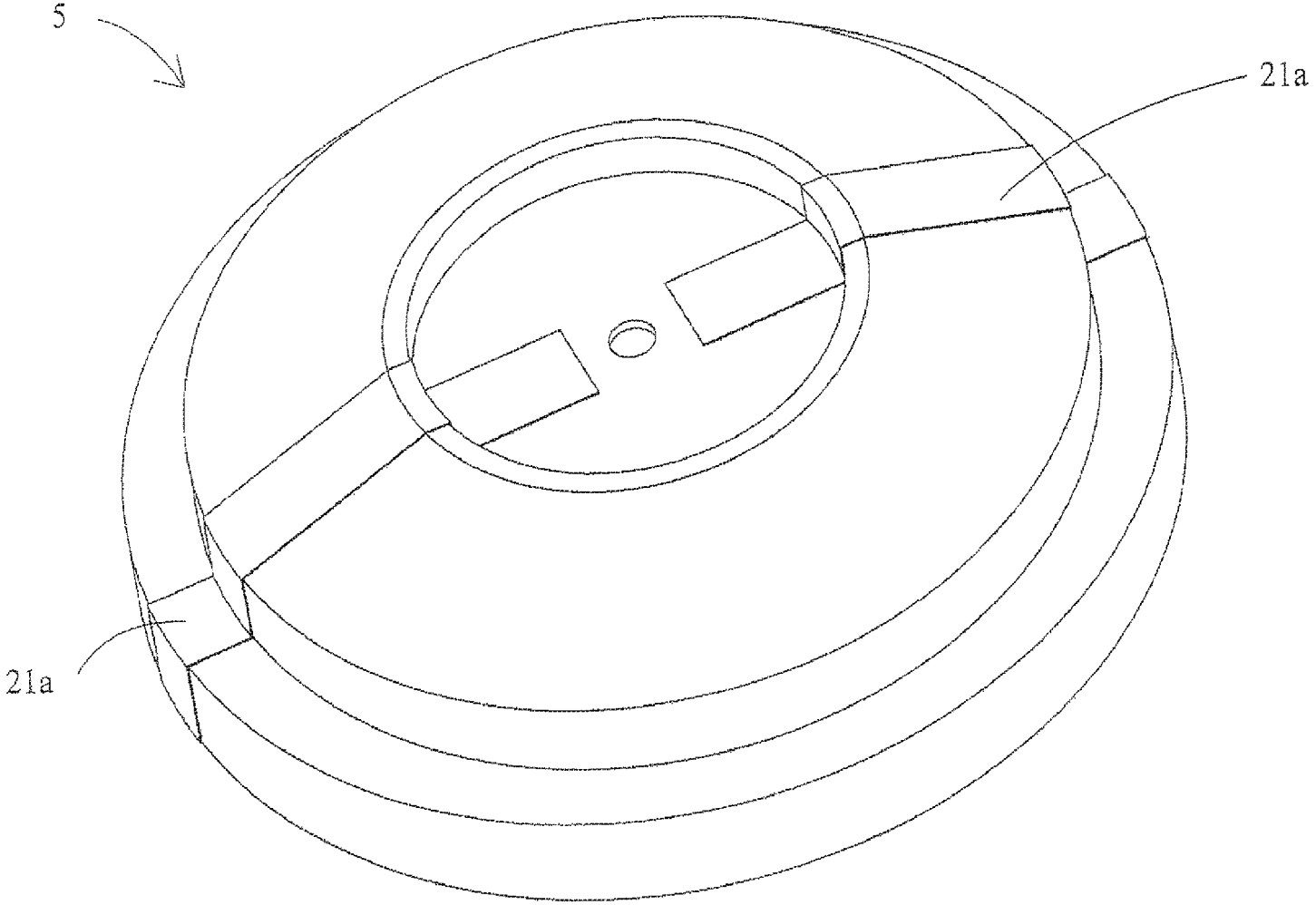
FIG. 9*c* is a perspective top-side view schematic illustration of an embodiment of a payload carrier's shell used with the second embodiment of an ignition unit.

FIG. 9*c* is a perspective top view schematic illustration of the payload's shell 5 required for use with the second embodiment of an ignition unit 1*a*.

Figure 9D:
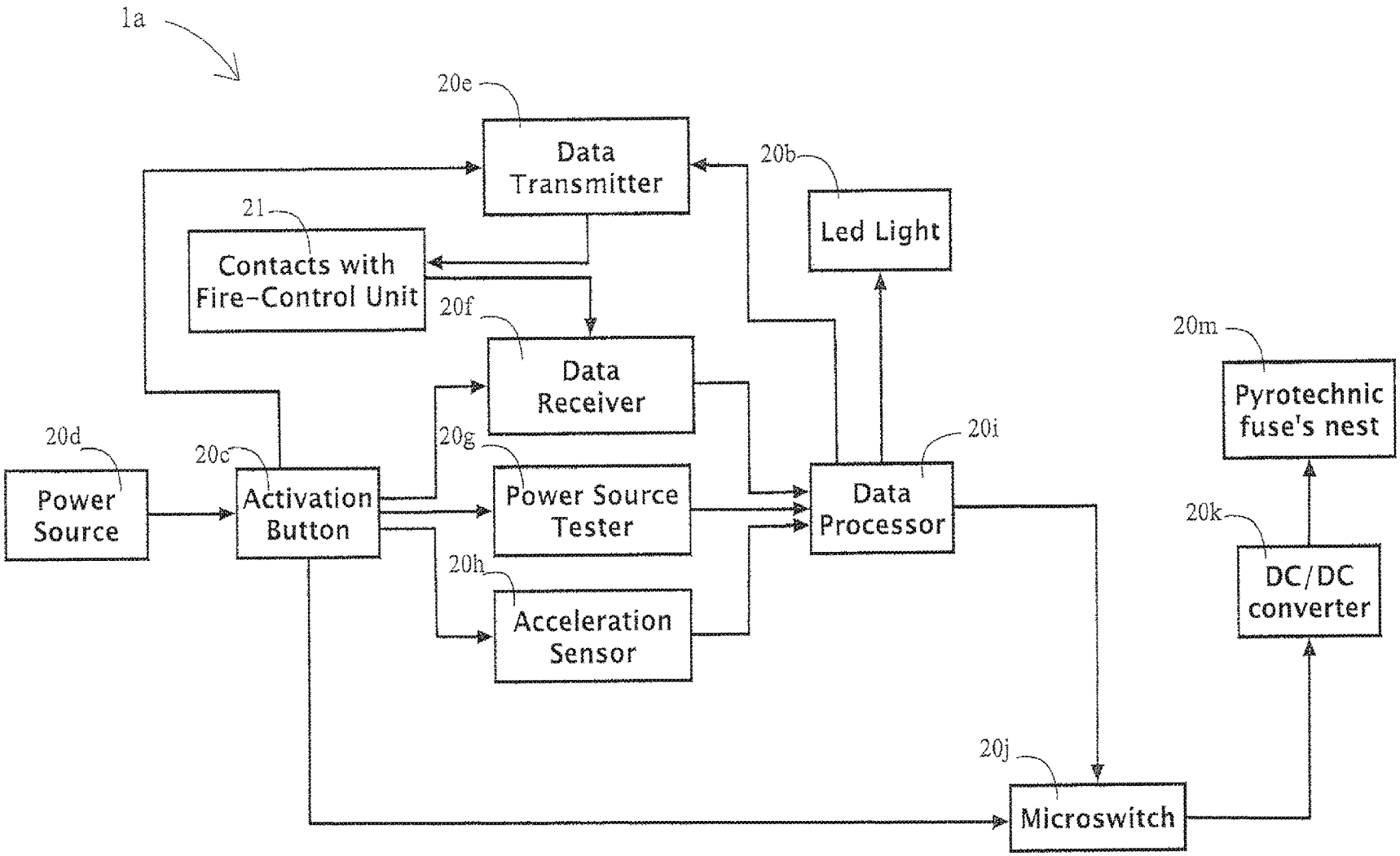
FIG. 9*d* is a block diagram of the electronic system of the second exemplary embodiment of an ignition unit.

FIG. 9*d* is a block diagram of the electronic system of the second exemplary embodiment of an ignition unit 1*a*. The launching of a projectile 1 that includes this embodiment of ignition unit 1*a* should be done by modified manual thrower (MMT) (FIG. 12*a*), modified mechanical launcher (MML) or modified automatic launcher (MAL) (FIG. 3*b*). The electronic system of the second exemplary embodiment of an ignition unit 1*a* includes a power source 20*d*, which supplies power through an activation button 20*c* that is operatively connected to a data transmitter 20*e*, a data receiver 20*f*, a power source tester 20*g*, an acceleration sensor 20*h* and a micro-switch 20*j*. A data processor 20*i* receives data from data receiver 20*f*, power source tester 20*g* and acceleration sensor 20*h* and outputs data to a LED light 20*b*, to micro-switch 20*j* and to data transmitter 20*e*. Data transmitter 20*e* outputs data it gets from activation button 20*c* and from data processor 20*i* to the ignition unit's contacts to fire-control unit 21. Micro-switch 20*j* receives data from data processor 20*i* and from activation button 20*c* and outputs a direct current (DC) voltage to a DC/DC converter 20*k* which converts this DC voltage to a level suitable for ignition of pyrotechnic fuse 6 (not shown in this figure) connected to pyrotechnic fuse nest 20*m*.

Upon system startup using activation button 20*c*, power source tester 20*g* informs data processor 20*i* when the power source 20*d* voltage level is suitable and data processor 20*i* lights up LED light 20*b*. Data processor 20*i* then receives required data (such as a delay time, an identification number, etc.) via wire transmission from the electrically contacting surface 40*a* of an automatic launcher's fire-control unit 41 (not shown in the present figure), from the similar fire-control unit of a mechanical launcher, or from the data contacts 21*a* of an MMT's fire-control unit 24*b* (not shown in the present figure) via data receiver 20*f*, the ignition unit's contacts to fire-control unit 21, and contact strips 21*a* that connect between the ignition unit and data contacts 24*a* of MMT 24 or contacting surface 40*a* of FIG. 3C. Then, data processor 20*i* signals a "ready" signal back through data transmitter 20*e* or by signaling with LED light 20*b*. When projectile 1 is launched, acceleration sensor 20*h* senses the launch and signals to data processor 20*i* that projectile 1 has been launched. Upon receiving the launch indication from acceleration sensor 20*h*, data processor 20*i* starts to count down the delay time received before launch. At the end of the countdown, data processor 20*i* signals micro-switch 20*j* to pass the DC voltage to pyrotechnic fuse nest 20*m* via DC/DC converter 20*k*, thereby detonating pyrotechnic fuse 6 (not shown in present figure).

Figure 9E:
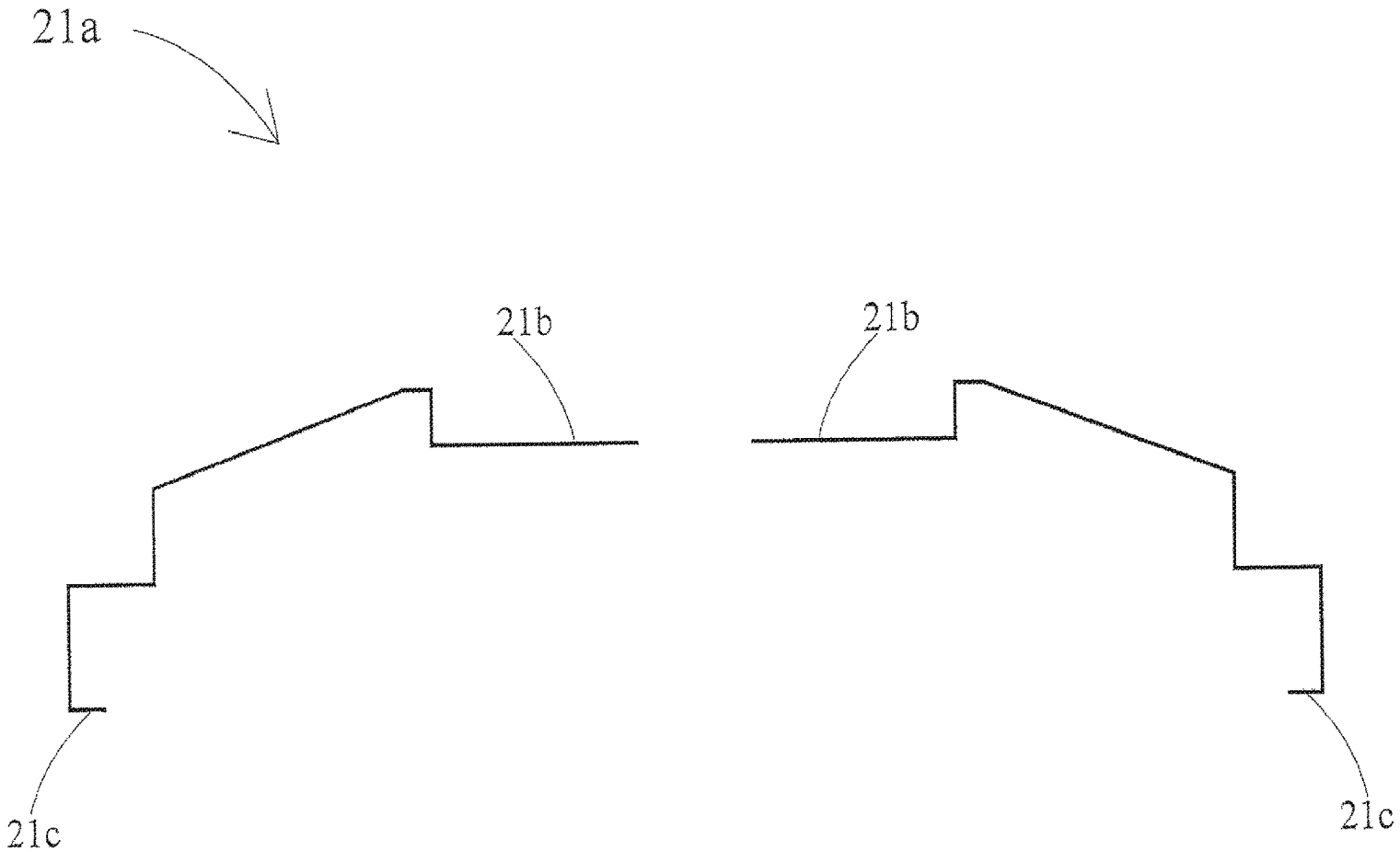
FIG. 9*e* is a cross sectional view of the contact strips that are added to the payload carrier's shell for the second embodiment of an ignition unit.

FIG. 9*e* is a cross sectional view of the contact strips 21*a* that are added to the payload carrier's shell 5 for use with the second embodiment of an ignition unit 1*b*. Contact strips 21*a*, mounted on the payload carrier's shell 5 as is shown in FIG. 9*c*, connect between the second embodiment of an ignition unit 1*b* (not shown in present figure) and data contacts 24*a* of an MMT (shown in FIG. 12*a*) or contacting surface 40*a* of an MAL or MML (shown in FIG. 3*c*). The ignition unit's contacts to fire-control unit 21 (shown in FIG. 9*b*) are connected, during the manufacturing process, to the surfaces 21*b* of the contact strips 21*a*. Surfaces 21*c* of contact strips 21*a* are in contact with data contacts 24*a* of an MMT (shown in FIG. 12*a*) or contacting surface 40*a* of a MAL or MML (shown in FIG. 3*c*) when projectile 1 is loaded into the MMT or onto the MAL or MML for launch.

Figure 10B:
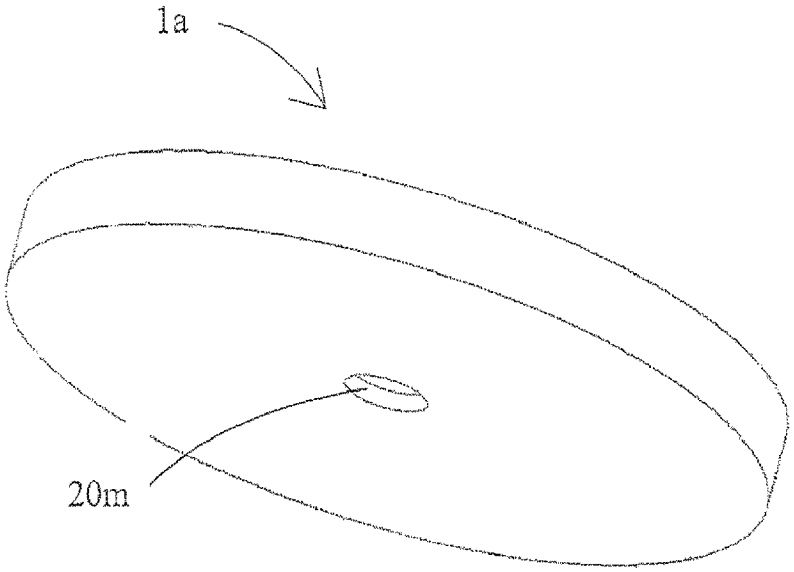
FIG. 10*b* is a perspective bottom-side view schematic illustration of the third embodiment of an ignition unit.
Figure 10A:
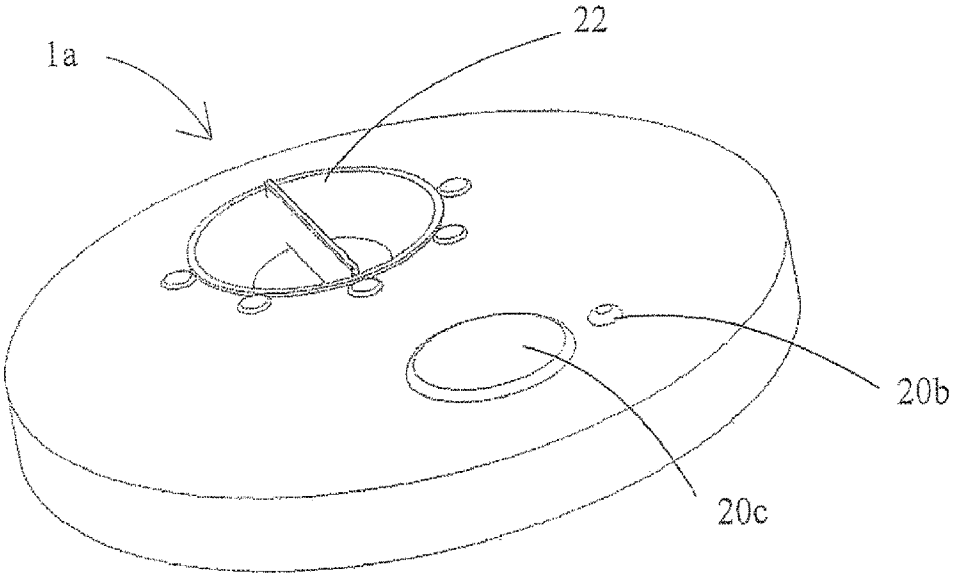
FIG. 10*a* is a perspective top-side view schematic illustration of the third embodiment of an ignition unit.

FIG. 10*a* is a perspective top view schematic illustration of a third embodiment of ignition unit 1*a*.

FIG. 10*b* is a perspective bottom view schematic illustration of the third embodiment of ignition unit 1*a*.

Figure 10C:
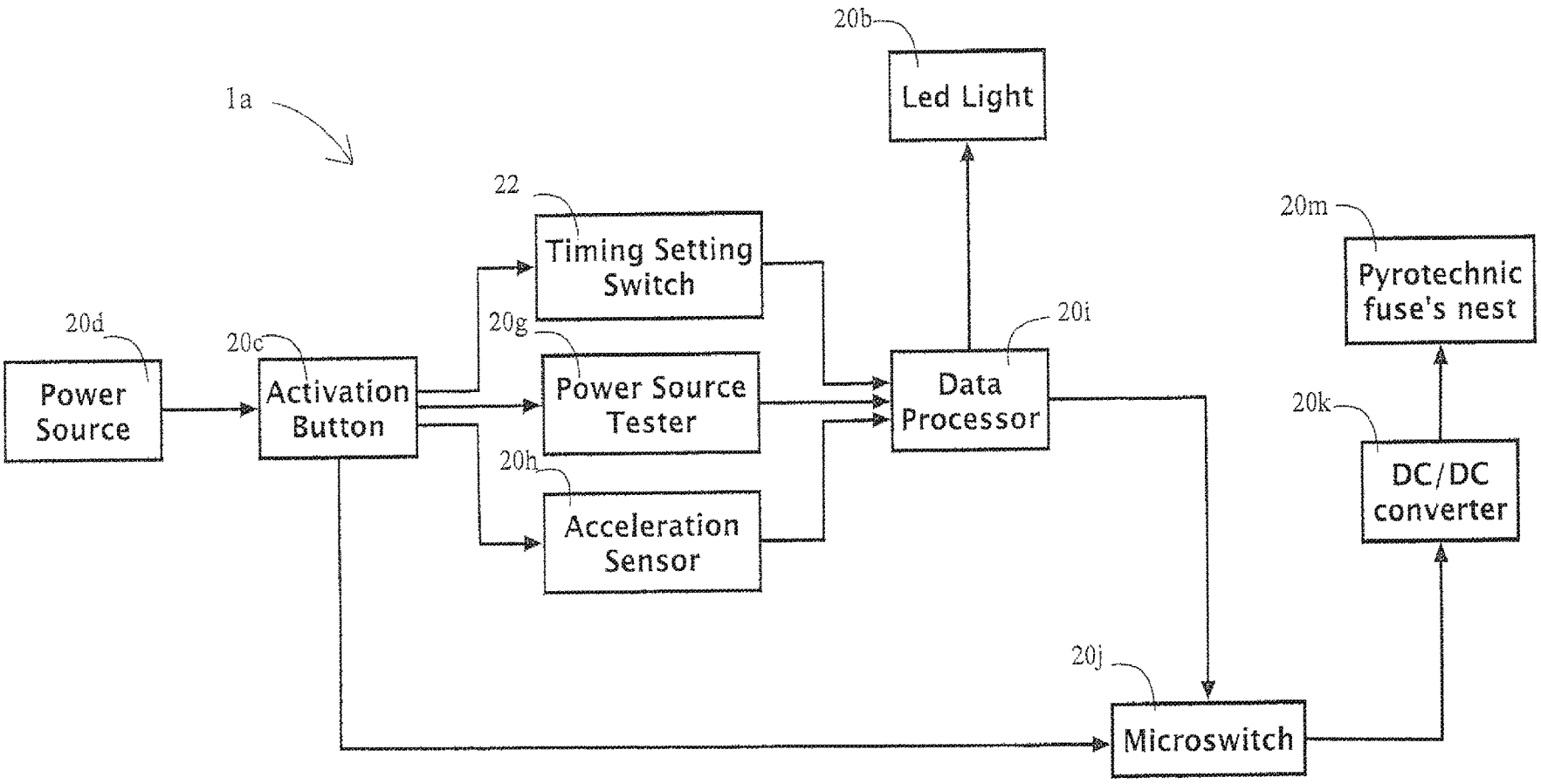
FIG. 10*c* is a block diagram of the electronic system of the third exemplary embodiment of an ignition unit.

FIG. 10*c* is a block diagram of the electronic system of the third exemplary embodiment of ignition unit 1*a*. The launching of a projectile 1 that includes this embodiment of ignition unit 1*a* can be done by a modified manual thrower (MMT), by a modified mechanical launcher (MML), by a modified automatic launcher (MAL) or by any prior art thrower/launcher. The electronic system of the third exemplary embodiment of ignition unit 1*a* includes a power source 20*d*, which supplies power through an activation button 20*c* that is operatively connected to a timing setting switch 22, to a power source tester 20*g*, to an acceleration sensor 20*h* and to a micro-switch 20*j*. A data processor 20*i* receives data from timing setting switch 22, from power source tester 20*g* and from the acceleration sensor 20*h* and outputs data to a LED light 20*b* and to a micro-switch 20*j*. Micro-switch 20*j* receives data from data processor 20*i* and from activation button 20*c* and outputs a direct current (DC) voltage to a DC/DC converter 20*k* that converts this DC voltage to a level suitable for ignition of pyrotechnic fuse 6 (not shown in this figure) connected to pyrotechnic fuse nest 20*m*.

Upon system startup using activation button 20*c*, power source tester 20*g* informs data processor 20*i* when the power source 20*d* voltage level is suitable and data processor 20*i* lights up LED light 20*b*. Data processor 20*i* then receives a delay time from timing setting switch 22. Then, data processor 20*i* signals a "ready" signal back by signaling with LED light 20*b*. When projectile 1 is launched, acceleration sensor 20*h* senses the launch and signals to data processor 20*i* that projectile 1 has been launched. Upon receiving the launch indication from acceleration sensor 20*h*, data processor 20*i* starts to count down the delay time received before launch. At the end of the count down, data processor 20*i* signals micro-switch 20*j* to pass the DC voltage to pyrotechnic fuse nest 20*m* via DC/DC converter 20*k*, thereby detonating pyrotechnic fuse 6 (not shown in present figure).

Figure 11B:
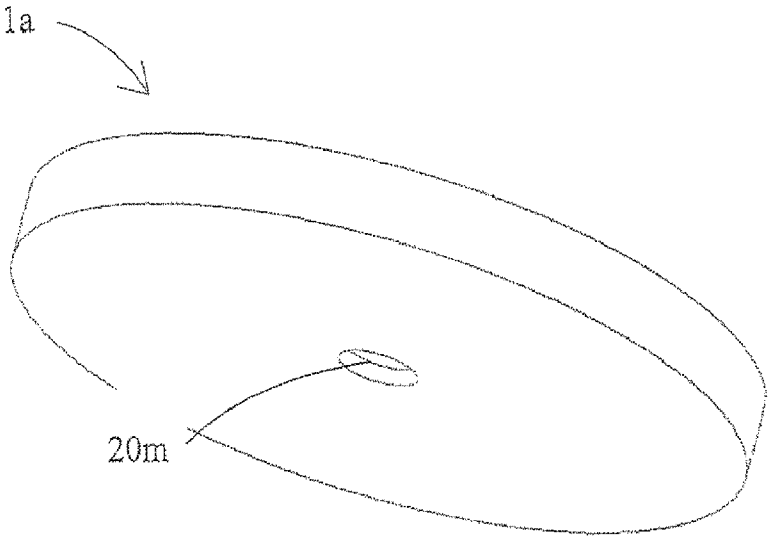
FIG. 11*b* is a perspective bottom-side view schematic illustration of the fourth embodiment of an ignition unit.
Figure 11A:
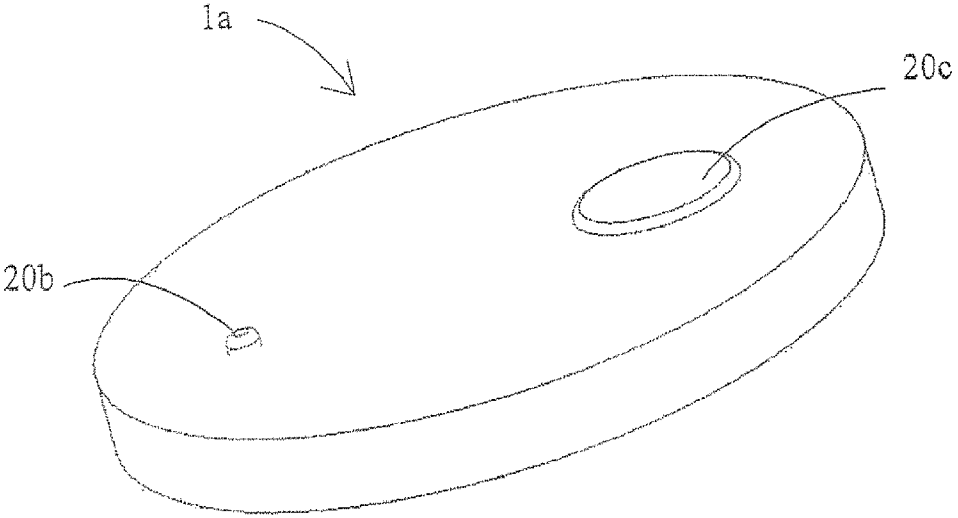
FIG. 11*a* is a perspective top-side view schematic illustration of the fourth embodiment of an ignition unit.

FIG. 11*a* is a perspective top view schematic illustration of a fourth embodiment of ignition unit 1*a*.

FIG. 11*b* is a perspective bottom view schematic illustration of the forth embodiment of ignition unit 1*a*.

Figure 11C:
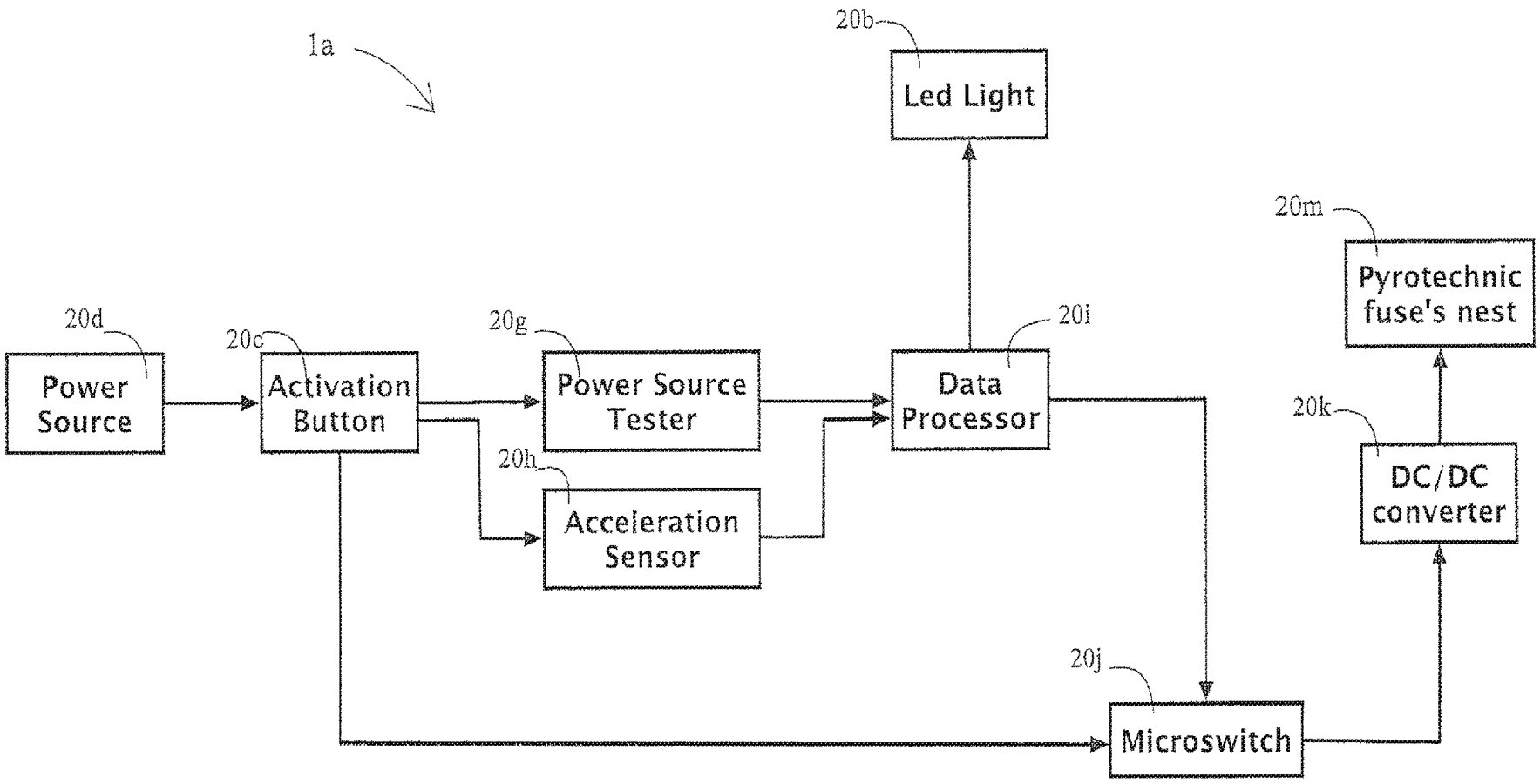
FIG. 11*c* is a block diagram of the electronic system of a fourth exemplary embodiment of an ignition unit.

FIG. 11*c* is a block diagram of the electronic system of the fourth exemplary embodiment of ignition unit 1*a*. The launching of a projectile 1 that includes this embodiment of ignition unit 1*a* can be done by a modified manual thrower (MMT), by a modified mechanical launcher (MML), by a modified automatic launcher (MAL) or by any prior art thrower/launcher. The electronic system of the fourth exemplary embodiment of ignition unit 1*a* includes a power source 20*d*, which supplies power through an activation button 20*c* that is operatively connected to a power source tester 20*g*, to an acceleration sensor 20*h* and to a micro-switch 20*j*. A data processor 20*i* has a default delay time programmed therein by the manufacturer of ignition unit 1*a* and receives data from power source tester 20*g* and from acceleration sensor 20*h*, and outputs data to a LED light 20*b* and to micro-switch 20*j*. Micro-switch 20*j* receives data from data processor 20*i* and from activation button 20*c* and outputs a direct current (DC) voltage to a DC/DC converter 20*k* that converts this DC voltage to a level suitable for ignition of pyrotechnic fuse 6 (not shown in this figure) connected to pyrotechnic fuse nest 20*m*.

Upon system startup using activation button 20*c*, power source tester 20*g* informs data processor 20*i* when the power source 20*d* voltage level is suitable, and data processor 20*i* lights up LED light 20*b*. Then, data processor 20*i* signals a "ready" signal back by signaling with LED light 20*b*. When projectile 1 is launched, acceleration sensor 20*h* senses the launch and signals to data processor 20*i* that projectile 1 has been launched. Upon receiving the launch indication from acceleration sensor 20*h*, data processor 20*i* starts to count down the default delay time that has been programmed by the manufacturer. At the end of the countdown, data processor 20*i* signals micro-switch 20*j* to pass the DC voltage to pyrotechnic fuse nest 20*m* via DC/DC converter 20*k*, thereby detonating pyrotechnic fuse 6 (not shown in present figure).

Figure 12A:
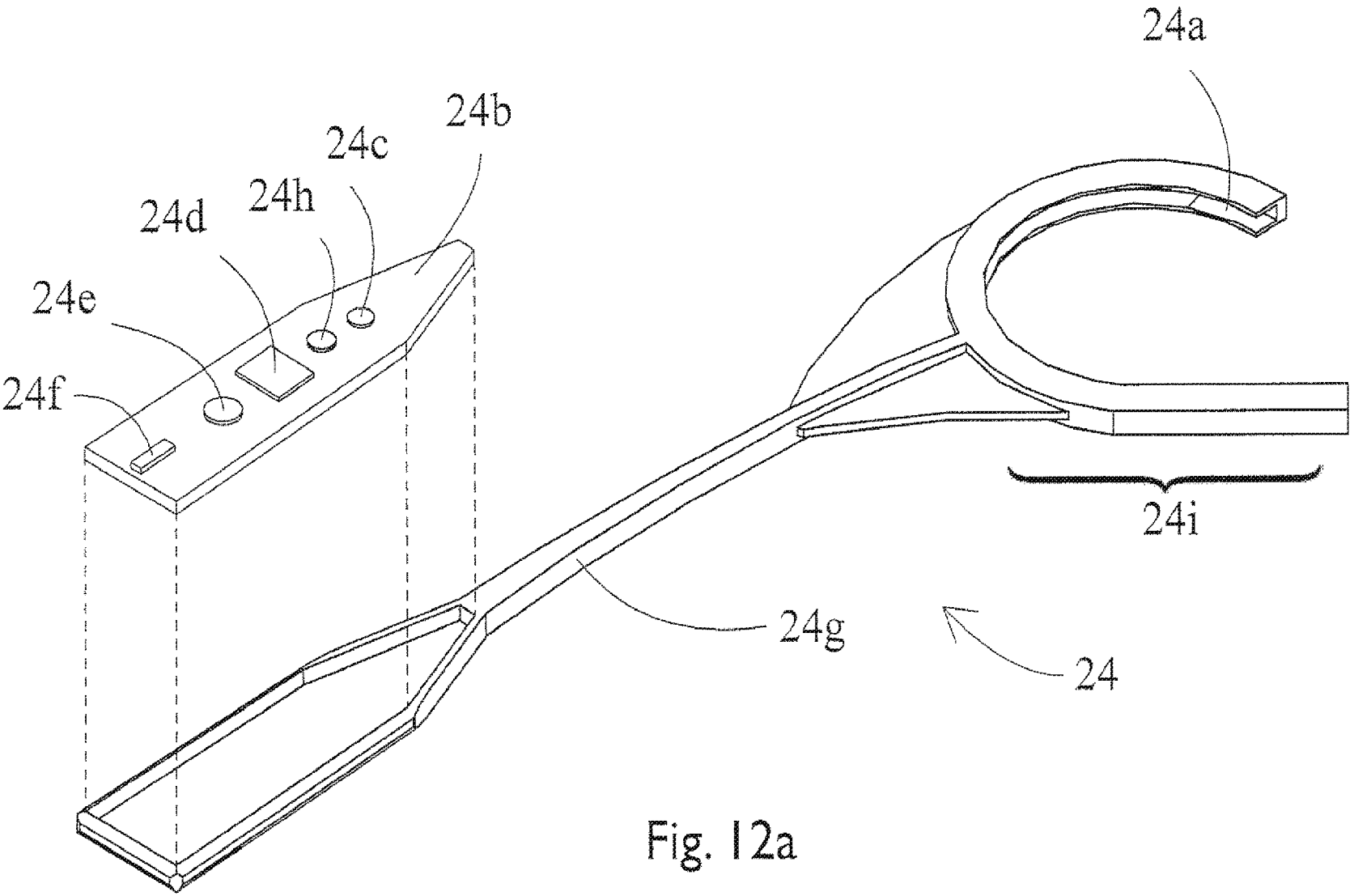
FIG. 12*a* is a perspective view of a modified manual thrower (MMT) of the present invention.

FIG. 12*a* is a perspective view of a modified manual thrower (MMT) 24. MMT 24 includes a fire-control unit 24*b*, data contacts 24*a* of a fire-control unit 24*b*, an antenna 24*c* of fire-control unit 24*b*, a screen 24*d* of fire-control unit 24*b*, a fire button/timing setting switch 24*e* of fire-control unit 24*b*, an "on/off" switch 24*f* of fire-control unit 24*b*, a mode switch 24*h* of fire control unit 24*b*, and a body 24*g* that terminates in a launch receptacle 24*i* in which data contacts 24*a* are embedded. Payloads 1 are loaded into receptacle 24*i* for launching. A payload 1, whose ignition unit 1*a* is the second embodiment of ignition unit 1*a*, is loaded into receptacle 24*i* for launching so that contact strips 21*a* make electrical contact with data contacts 24*a*.

Figure 12B:
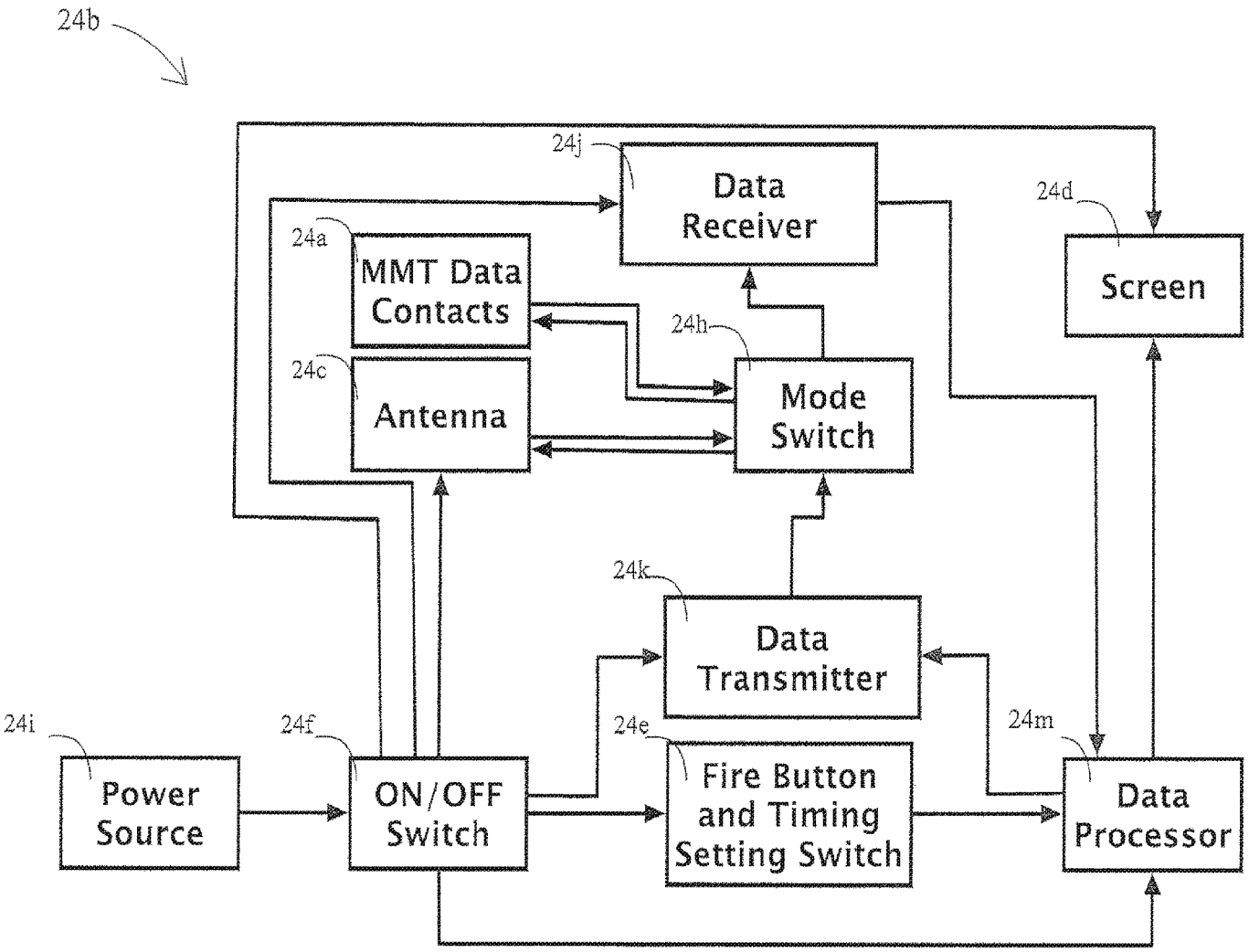
FIG. 12*b* is a block diagram of the electronic system of an exemplary modified manual thrower (MMT) of the present invention.

FIG. 12*b* is a block diagram of the electronic system of the fire control unit 24*b* of MMT 24. The electronic system of fire control unit 24*b* includes a power source 24*i*, which supplies power through an "on/off" switch of fire-control unit 24*f*, that is operatively connected to an antenna 24*c*, to a data receiver 24*j*, to a data transmitter 24*k*, to a fire button/timing setting switch 24*e* of fire-control unit 24*b*, a screen 24*d*, and a data processor 24*m*. Mode switch 24*h* is connected to data transmitter 24*k* and to data receiver 24*j* and directs data to/from antenna 24*c* or data contacts 24*a* according to the embodiment (first or second) of the ignition unit 1*a* that is installed in a launched projectile 1. If the embodiment of ignition unit 1*a* is the first embodiment of ignition unit 1*a*, then mode switch 24*h* directs data to/from antenna 24*c*. If the embodiment of ignition unit 1*a* is the second embodiment of ignition unit 1*a*, then mode switch 24*h* directs data to/from data contacts 24*a*. Fire button/timing setting switch 24*e* has two optional functions: to set the delay time for the first and second embodiments of ignition units 1*a* and to issue the detonation command for the first embodiment of ignition unit 1*a*. Data processor 24*m* receives data from on/off switch 24*f*, from fire button/timing setting switch 24*e* and from data receiver 24*j* and outputs data to screen 24*d* and to data transmitter 24*k*.

Upon system startup using on/off switch 24*f*, the user sets mode switch 24*h* and fire button/timing setting switch 24*e* according to the type of ignition units 1*a* in use. Data processor 24*m* receives data from fire button/timing setting switch 24*e* and transfers the data via data transmitter 24*k* and mode switch 24*h*, which directs the data via antenna 24*c* or via data contacts 24*a* to ignition unit 1*a*. The data received from ignition unit 1*a* is directed by mode switch 24*h* to data receiver 24*j* and then to data processor 24*m*. Information received by data processor 24*m* is displayed on screen 24*d*.

Figure 13:
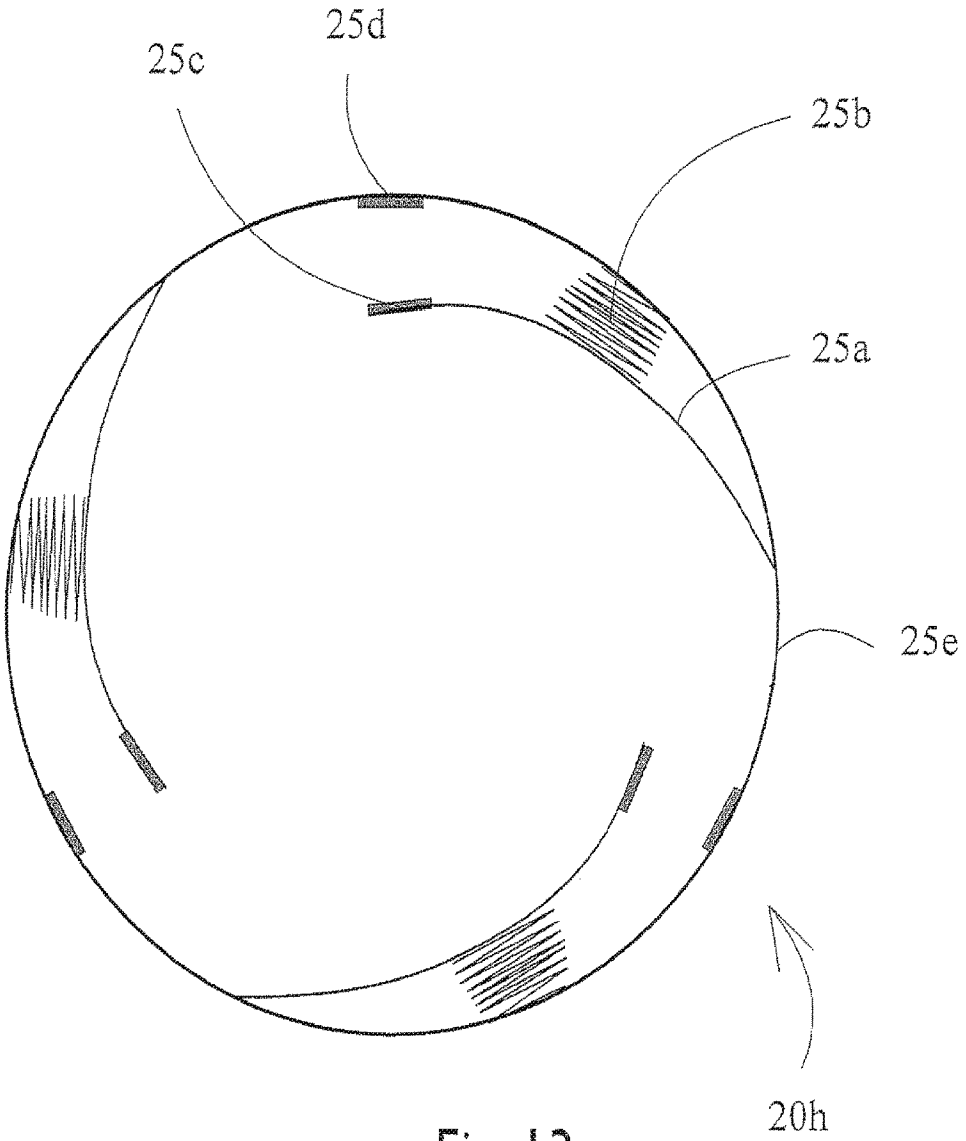
FIG. 13 is a top-view schematic illustration of the mechanical embodiment of an acceleration sensor.

FIG. 13 is a top view schematic illustration of a mechanical embodiment of an acceleration sensor 20*h*. This embodiment of acceleration sensor 20*h* includes arm members 25*a*, springs 25*b*, first accelerometer contacts 25*c*, second accelerometer contacts 25*d* and an external member 25*e*.

After the launching of a projectile 1, the centrifugal force created by the spinning of projectile 1 compresses springs 25*b* that are placed between arm members 25*a* and external member 25*e*. As a result, first accelerometer contacts 25*c* touch second accelerometer contacts 25*d*, and acceleration sensor 20*h* outputs a signal to data processor 20*i* (not shown in this figure) to inform data processor 20*i* that projectile 1 has been launched.

Figure 14:
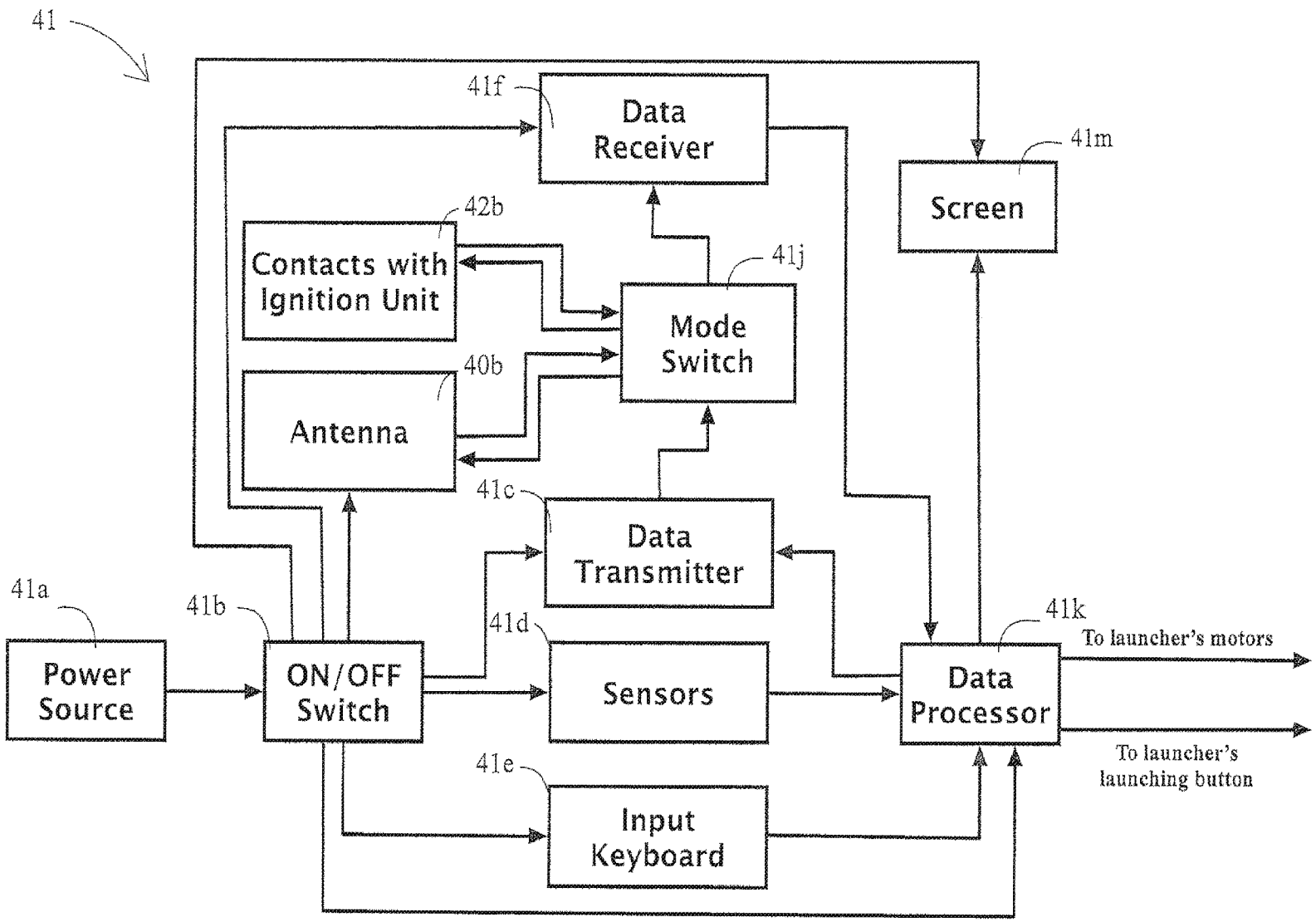
FIG. 14 is a block diagram of the electronic system of an exemplary modified automatic launcher (MAL) according to the present invention.

FIG. 14 is a block diagram of the electronic system of fire control unit 41 of a MAL. The electronic system of fire control unit 41 includes a power source 41*a*, which supplies power through an "on/off" switch 41*b*, that is operatively connected to antenna 40*b*, to a data receiver 41*f*, to a data transmitter 41*c*, to sensors 41*d*, to an input keyboard 41*e*, to a screen 41*m*, and to data processor 41*k*. Mode switch 41*j* is connected to data transmitter 41*c* and to data receiver 41*f* and directs data to/from antenna 40*b* or electrical contacts 42*b* according to which embodiment of ignition unit 1*a* is installed in the launched projectiles 1. If the embodiment of ignition unit 1*a* that is installed in projectiles 1 is the first embodiment of ignition unit 1*a*, then mode switch 41*j* directs data to/from antenna 40*b*. If the embodiment of ignition unit 1*a* that is installed in projectiles 1 is the second embodiment of ignition unit 1*a*, then mode switch 41*j* directs data to/from electrical contacts 42*b*. Input keyboard 41*e* is used to input different required data, such as a delay time for the first and second embodiments of ignition units 1*a*; the immediate detonation command for the first embodiment of ignition unit 1*a*; the number of projectiles to launch; the direction of fire, etc. Sensors 41*d* collect environmental data such as the angle of the launcher, the wind direction and speed, and/or the ambient temperature, and output the environmental data to data processor 41*k*. Data processor 41*k* receives data from on/off switch 41*b*, from input keyboard 41*e*, from sensors 41*d* and from data receiver 41*f*, and outputs data to screen 41*m*, to data transmitter 41*c* and to the motors and the launching button of MAL 40, which are placed in the main body of the MAL (not shown in this figure).

Upon system startup using on/off switch 41*b*, the user sets mode switch 41*j* and uses input keyboard 41*e* to input all required data. Data processor 41*k* receives data from input keyboard 41*e* and transfers the received data via data transmitter 41*c* and mode switch 41*j*, which directs the data to antenna 40*b* or to electrical contacts 42*b*. Data received from the ignition unit 1*a* of a projectile 1 that is to be launched is directed by mode switch 41*j* to data receiver 41*f* and then to data processor 41*k*. Data received from sensors 41*d* and from input keyboard 41*e* is transferred by data processor 41*k* to the MAL's motors and launching button. Information received by processor 41*k* is displayed on screen 41*m*.

Figure 1:
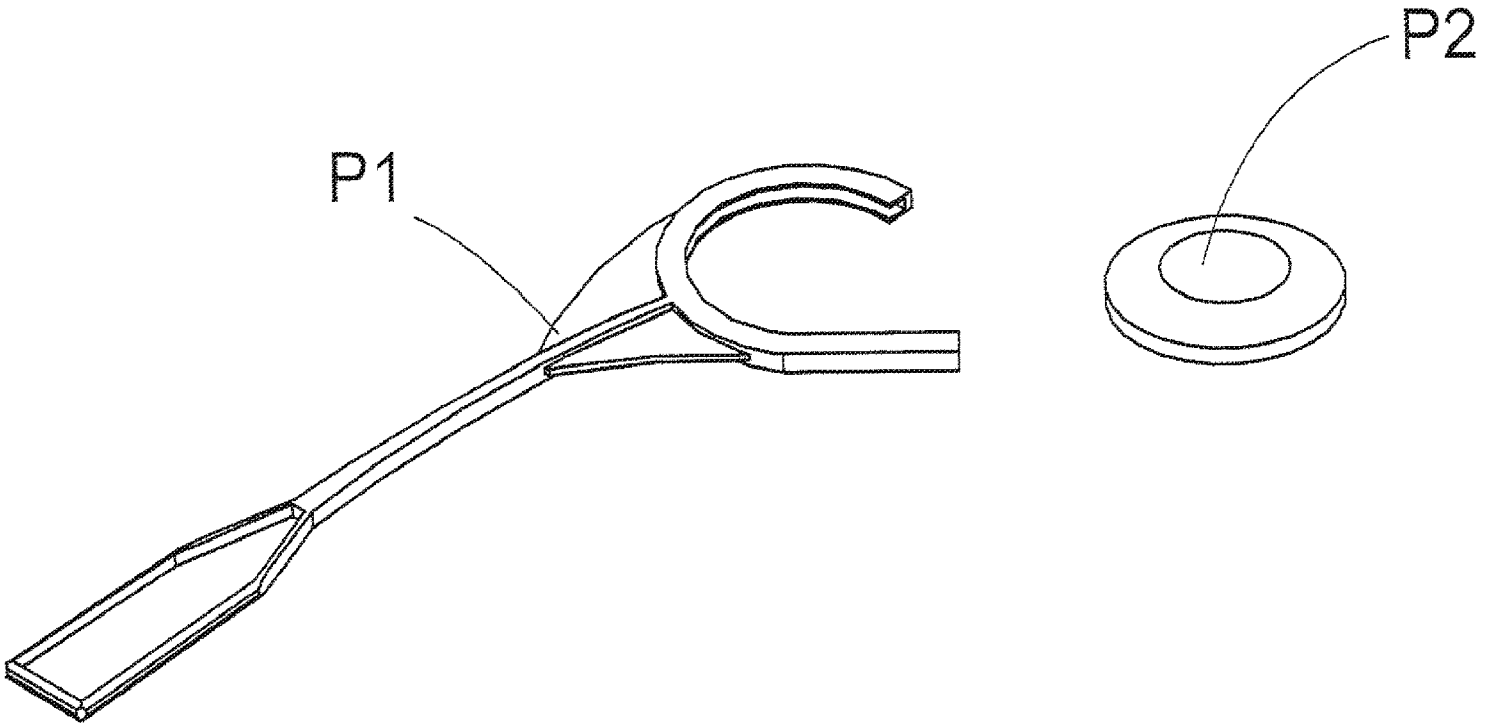
Fig. 1 PRIOR ART
FIG. 1 is a perspective schematic illustration of a prior art manual thrower and a prior art clay target.
Figure 2:
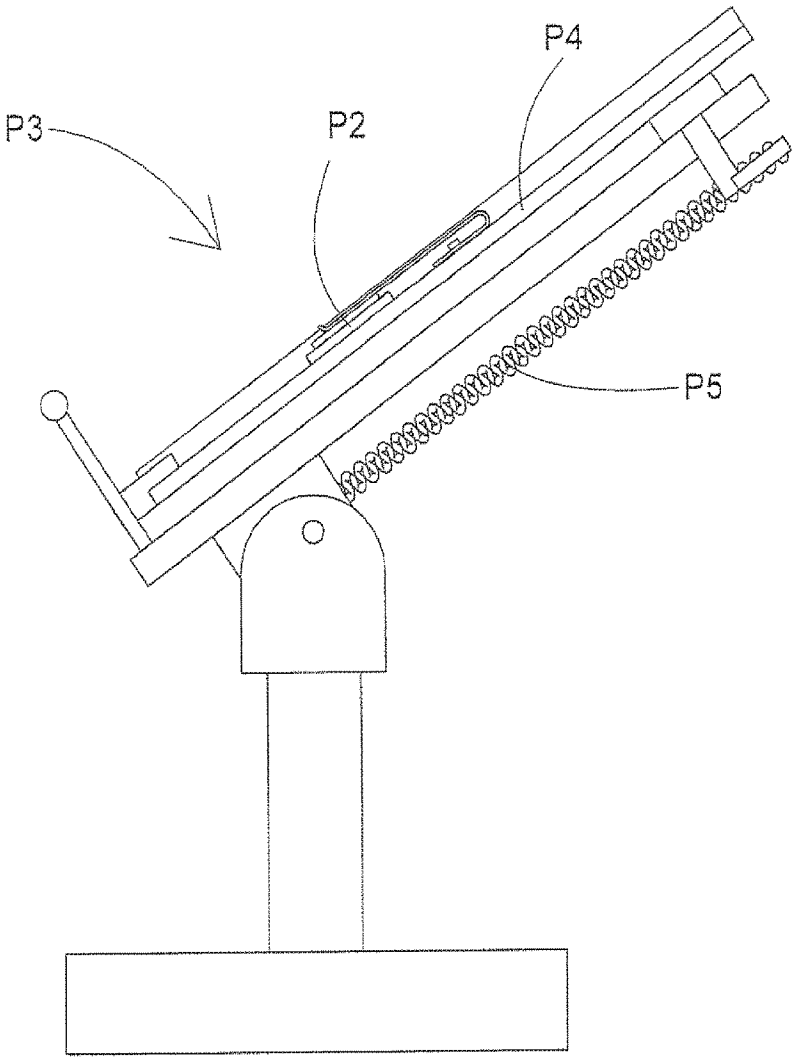
Fig. 2 PRIOR ART
FIG. 2 is a side view schematic illustration of a prior art mechanical launcher.

Prior art mechanical launcher P3 of FIG. 2 is modified to be a MML of the present invention in a manner similar to how prior art automatic launcher P6 of FIG. 3*a* is transformed into MAL 40 of the present invention. The description above of MAL 40 applies, mutatis mutandis, to a MML of the present invention. In particular, the description above of the structure and use of fire control unit 41 applies, mutatis mutandis, to the fire control unit of a MML of the present invention.

While the invention has been described with respect to a limited number of embodiments, it will be appreciated that many variations, modifications and other applications of the invention may be made. Therefore, the claimed invention as recited in the claims that follow is not limited to the embodiments described herein.

What is claimed is:

1. A system comprising a disk-shaped projectile for dispersing non-lethal incapacitating agents for crowd control, for projection by a mechanical launcher, and a mechanical launcher, wherein the projectile comprises:

a sensor for sensing a launch of the disk-shaped projectile from the mechanical launcher;

a disk-shaped housing having:

a shell including a recess at a top portion thereof, a planar bottom cover, and a payload carrier compartment defined between the shell and the bottom cover that contains a powder irritant agent, a pyrotechnic fuse at least partially seated in a hollow central aperture of the shell;

an ignition unit seated within the recess, the ignition unit electrically connected to said pyrotechnic fuse and configured for igniting said pyrotechnic fuse for creating an explosion for at least one of tearing through the bottom cover and disconnecting the bottom cover from the shell to allow dispersing said powder irritant agent in the air as said powder irritant agent falls out of said shell;

a timing setting switch for delaying said igniting by a predetermined delay after said launch is detected by said sensor for performing said igniting when said disk-shaped projectile is above a crowd;

an antenna located in and electrically connected to said ignition unit and configured to receive a signal from the mechanical launcher encoding said predetermined delay and to transmit a return signal to the mechanical launcher indicating readiness to launch, and processing circuitry configured to transmit the predetermined delay received by the antenna to the timing setting switch;

and the mechanical launcher comprises:

a second antenna configured to transmit the signal to the disk-shaped projectile encoding said predetermined delay and to receive the return signal from the disk-shaped projectile indicating readiness to launch; and a launching arm having a launching surface directly contacting and moving the disk-shaped projectile prior to and during a launch, and wherein the ignition unit does not contact the launching surface prior to and during a launch; and a fire control unit with an electronic system, wherein the electronic system includes (1) at least one sensor for sensing environmental data comprising one or more of an angle of said launcher, a wind direction, a wind speed, and an ambient temperature; and (2) a processor for calculating the predetermined delay according to the environmental data received by the at least one sensor.

2. The disk-shaped projectile of claim 1, further comprising at least one electric contact for electrically coupling with an electric contact of the mechanical launcher for receiving a signal encoding said predetermined delay.

3. The disk-shaped projectile of claim 1, wherein the projectile lacks a propulsion mechanism.

4. The disk-shaped projectile of claim 1, wherein the projectile has a shape of a clay pigeon.

5. The disk-shaped projectile of claim 1, wherein said powder irritant agent is a riot control agent.

6. The disk-shaped projectile of claim 5, wherein said riot control agent includes an active riot control agent.

7. The disk-shaped projectile of claim 2, wherein said electric contact is located on said bottom cover.

8. The disk-shaped projectile of claim 1, wherein said predetermined delay is set manually by an interface for manual setting.

9. The disk-shaped projectile of claim 1, wherein said sensor senses said launch by sensing an acceleration of the projectile.

10. The disk-shaped projectile of claim 1, wherein said payload carrier compartment comprises a heat generating material.

11. The disk-shaped projectile of claim 1, wherein said ignition unit is placed above said payload carrier compartment in a niche of said shell.

12. The disk-shaped projectile of claim 11, wherein said pyrotechnic fuse is located in said niche.

13. The disk-shaped projectile of claim 1, further comprising contact strips that connect said ignition unit to at least one data contact of said mechanical launcher, the contact strips configured to transfer data between the ignition unit and the mechanical launcher.

14. The disk-shaped projectile of claim 1, wherein said sensor senses said launch by sensing centrifugal force created by the spinning of the disk-shaped projectile.

15. The disk-shaped projectile of claim 14, wherein said sensor comprises springs compressed by said centrifugal force.

16. The disk-shaped projectile of claim 1, wherein said predetermined delay is calculated according environmental data selected from a group consisting of an angle of said launcher, a wind direction, a wind speed, and an ambient temperature.

17. The system of claim 1, wherein the launching arm comprises a planar launching surface for contacting and moving the disk-shaped projectile prior to and during a launch, and wherein the planar bottom cover of the disk-shaped housing contacts the launching surface prior to and during a launch.

18. The system of claim 1, wherein the launching arm comprises an arcuate receptacle for contacting and moving the disk-shaped projectile prior to and during a launch, wherein a lateral surface of the disk-shaped housing contacts the arcuate receptacle prior to and during a launch.

* * * * *